US007293865B2

(12) United States Patent
Tsukuda et al.

(10) Patent No.: US 7,293,865 B2
(45) Date of Patent: Nov. 13, 2007

(54) INK JET RECORDING HEAD, AND INK CONTAINER

(75) Inventors: Keiichiro Tsukuda, Yokohama (JP); Kazuhiko Okito, Hiratsuka (JP); Hiroshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 366 days.

(21) Appl. No.: 10/995,359

(22) Filed: Nov. 24, 2004

(65) Prior Publication Data

US 2005/0117002 A1 Jun. 2, 2005

(30) Foreign Application Priority Data

Nov. 27, 2003 (JP) ..... 2003-397296
Oct. 22, 2004 (JP) ..... 2004-308524

(51) Int. Cl.
*B41J 2/175* (2006.01)
*B41J 2/14* (2006.01)

(52) U.S. Cl. ..... 347/86; 347/50

(58) Field of Classification Search ..... 347/50, 347/86, 87

See application file for complete search history.

(56) References Cited

U.S. PATENT DOCUMENTS 5,506,611 A 4/1996 Ujita et al. ..... 347/86
5,512,926 A 4/1996 Uchikata et al. ..... 347/86
5,616,929 A 4/1997 Hara ..... 250/573
5,619,237 A 4/1997 Inoue et al. ..... 347/86
5,784,088 A 7/1998 Ujita et al. ..... 347/86
5,975,688 A 11/1999 Kanaya et al. ..... 347/86
5,988,804 A 11/1999 Kotaki et al. ..... 347/87
6,102,533 A 8/2000 Nozawa et al. ..... 347/86
6,170,939 B1 1/2001 Ujita et al. ..... 347/86
6,474,800 B1 11/2002 Baitz et al. ..... 347/86

FOREIGN PATENT DOCUMENTS

JP 5-169673 7/1993
JP 6-262771 9/1994
JP 7-128321 8/1995
JP 7-309015 11/1995
JP 8-169122 7/1996
JP 2001-191551 7/2001
WO 00/12310 3/2000

*Primary Examiner*—An H. Do
(74) *Attorney, Agent, or Firm*—Fitzpatrick, Cella, Harper & Scinto

(57) ABSTRACT

An ink container detachably mountable to a recording head, the recording head including an ink jet recording chip which is driven by a driving voltage supplied through a driving voltage wiring lead and an electric signal supplied through an electric signal wiring lead to eject ink, an electrical opening portion provided in at least one of the driving voltage wiring lead and the electric signal wiring lead, the ink container includes a connection element for establishing electrical connection by electrically closing the electrical opening portion when the ink container is mounted to the recording head.

8 Claims, 15 Drawing Sheets

(a)

(b)

(a)

(b)

(a)

(b)

(a)

(b)

INK JET RECORDING HEAD, AND INK CONTAINER

FIELD OF THE INVENTION AND RELATED ART

The present invention relates to an ink jet recording apparatus, an ink jet recording head, and an ink container, for recording on a recording medium by ejecting ink from the recording head.

An ink jet recording apparatus is a recording apparatus of a so-called nonimpact type, being characterized in that it generates virtually no noise while recording, and also, that not only is it capable of recording at a high speed, but also, it is capable of recording on various types of recording medium. Thus, an ink jet recording apparatus is widely employed as an apparatus which bears the role of the recording mechanism in an image forming apparatus such as a printer, a copying machine, a facsimileing machine, a wordprocessor, etc.

As the representative ink ejecting systems for a recording head to be mounted in an ink jet recording apparatus, those which employ electromechanical transducing elements such as piezoelectric elements, those which irradiate ink with electromagnetic waves, such as laser light, in order to eject ink droplets by utilizing the effect of the heat generated in the ink, those which heat ink with the use of electrothermal transducing elements having heat generating resistor(s), in order to eject ink droplets by utilizing the so-called film boiling phenomenon, etc., have been known.

Among the above described ink ejecting systems, the ink ejecting system (recording head) which employs electrothermal transducing elements is as follows: An electrothermal transducing element is placed in a recording liquid chamber. The ink in the recording ink chamber is heated (thermal energy is given to ink) by supplying the electrothermal transducing element with electric pulses as recording signals to change the ink in phase, so that the bubble pressure generated as the recording liquid changes in phase from the liquid state to the gas state, that is, as the recording liquid boils, is used to eject the recording liquid (ink) from minute ejection orifices to record on recording medium. Generally, a recording head employing electrothermal transducing elements comprises nozzles having an ejection orifice through which ink droplets are ejected, ink passages through which ink is supplied to the nozzles, and a common liquid chamber.

FIG. 20 is a perspective view of a typical ink jet recording apparatus in accordance with the prior art. The recording apparatus 115 has a recording head 102, an ink container unit 103, a paper conveying roller 4, a carriage 5, a motor 6, etc. The paper conveying roller 4 is driven by the motor 6. A recording medium P is conveyed by the paper conveying roller 4 at an optional pitch. The ink container unit 103 has four ink containers which contain black, cyan, magenta, and yellow inks, for example, one for one. The ink container unit 103 is mounted, along with the recording head 102, on the carriage 5, and is moved along guide rails 7 and 8, in the direction perpendicular to the direction in which the recording medium P is conveyed. Ink is ejected from the recording head 102 by electrical signals sent and driving voltage sent from the circuit (unshown) on the main assembly side, forming an image on the recording medium P; recording is made on the recording medium P.

There are various types of recording head: disposable type recording head, which is integral with an ink container; permanent type recording head, which is separable from an ink container; semipermanent type recording head, which is separable from a recording apparatus as well as an ink container; etc. In recent years, however, the recording heads of the semipermanent and permanent types, which do not need to be discarded after the depletion of the ink in the ink container, have come to be proposed by a greater number than the recording heads of the disposable type, because of environmental concerns, and also, in order to reduce the running cost of an ink jet recording apparatus.

In the case of an ink jet recording apparatus, the recording head of which is separable from an ink container, it is possible that print signals will be sent to the recording head, which an operator forgot to refit with an ink container while replacing the ink depleted ink container. If print signals are sent to the recording head not fitted with an ink container, the electrothermal transducing elements are driven while no ink is sent to the recording head. As a result, the temperature of the electrothermal transducing elements becomes very high, causing the ingredients, such as dye, pigments, etc., in the small amount of ink remaining in the recording head to be baked onto the surfaces of the electrothermal transducing elements. Once the above-mentioned ingredients of ink are baked onto the surfaces of the electrothermal transducing elements, it is possible that even when the recording head is supplied with ink, the electrothermal transducing elements will fail to normally boil the ink, causing the ink to be abnormally ejected.

In the case of an ink jet recording apparatus which employs a plurality of independently replaceable ink containers, it is possible for a given ink jet head to be fitted with an incorrect ink container, that is, an ink container which contains such ink that is not intended for the given ink jet head. If an ink jet head is fitted with an incorrect ink container, not only is it impossible to yield the normal results, but also, various other problems occur. For example, in the case that the electrothermal transduing elements in the plurality of ink jet heads different in the color of the inks they use are different in driving requirements, it is possible that ink ingredients will be baked onto the electrothermal transducing elements. Also in the case that an ink container is depleted of ink, an ink jet head cannot be supplied with ink, resulting in the same problems as those which occur when a user forgets to fit an ink jet head with an ink container. Therefore, it is common practice to count the number of ink droplets ejected from an ink jet head, in order to measure the amount of the ink remaining in the ink container. However, the method for estimating the amoun of the ink remainder by counting the number of the ink droplets is substantial in error. Therefore, in order to more accurately estimate the amount of the ink remainder, the different types of method for measuring the ink remainder have been proposed. According to one of such methods, the amount of the ink remainder is estimated based on the fact that the manner in which a beam of light projected into an ink container from the main assembly of a recording apparatus is reflected is affected by the presence (or absence) of ink in the ink container. Thus, an ink container is provided with a prism, which is located on the bottom surface of the ink container (for example, Japanese Laid-open patent application 7-218321).

This method, however, has been suffering from the following problem. That is, even though the recording apparatus is provided with a system for detecting the amount of the ink remainder in an ink container, the system cannot detect whether or not a given ink jet head is fitted with an ink container. Therefore, it is necessary to provide the recording apparatus with a system for detecting whether or not a given ink jet head is fitted with an ink container. Besides, even if a recording apparatus is equipped with a system for detecting whether or not a given ink jet head is fitted with an ink container, the system cannot detect whether or not a given ink jet head is fitted with an ink container, the ink in which is correct in color. Therefore, there is the possibility that the recording apparatus will print abnormal images, and/or the ink ingredients will be baked onto electrothermal transducing elements.

SUMMARY OF THE INVENTION

The present invention was made in consideration of the above described problems, and therefore, its primary object is to provide an ink jet recording apparatus, an ink jet head, and an ink container, which are highly reliable in that if the ink jet head of the ink jet recording apparatus is not fitted with the ink container, or is fitted with an incorrect ink container, the electrothermal transducing elements are prevented by a simple and reliable method from being driven, preventing thereby ink ingredients from being baked onto the heater.

According to an aspect of the present invention, there is provded an ink container detachably mountable to a recording head, said recording head including an ink jet recording chip which is driven by a driving voltage supplied through a driving voltage wiring lead and an electric signal supplied through an electric signal wiring lead to eject ink, an electrical opening portion provided in at least one of said driving voltage wiring lead and said electric signal wiring lead, said ink container comprising a connection element for establishing electrical connection by electrically closing the electrical opening portion when said ink container is mounted to the recording head.

According to an further of the present invention, there is provded a recording head according to claim 8, wherein said electrical opening portion is constituted by electrically insulated two contacts and a switch connected to one of said contacts, wherein said ink container has a projection at a position facing said switch, and wherein when said ink container is mounted to said recording head cartridge, said switch is depressed by said projection to contact to another said contact so that electrical opening portion is electrically closed.

According to an further aspect of the present invention, there is provded a recording head cartridge claim 8, wherein said electrical opening portion is constituted by electrically insulated two contacts, and said ink container has a connection wiring lead at a position facing both of said contacts, and wherein when said ink container is mounted to said recording head cartridge, said connection wiring lead contacts both of said contacts to close said electrical opening portion.

According to a further aspect of the present invention, there is provded a recording device wherein by detecting presence or absence of electrical conduction at the electrical opening portion of said recording head cartridge, presence or absence of a mounted ink container which is to close said electrical opening portion.

An electrothermal transducing element does not function unless it is supplied with both driving voltage and an electrical signal. Therefore, the problem that an electrothermal transducing element is driven while an ink jet head is not in connection with an ink container, and/or that ink ingredients are baked onto an electrothermal transducing element by an excessive amount, can be prevented by structuring an ink jet recording apparatus so that at least one of the driving voltage and electrical signal is not supplied unless an ink jet head is in connection with an ink container.

An ink jet recording apparatus which employs multiple ink containers different in the color of the ink they contain can be structured so that one or both of the electrical wire for the driving voltage and the electrical wire for electrical signal are provided with a single or multiple electrically open (discontinuous) portions, based on the color of the ink. It may be structured so that the multiple ink containers different in the color of the inks they contain are different in at least one of the position and configuration of the electrically open (discontinuous) portion and connective element.

The electrically open portion can be structured as follows: It comprises a pair of contact points which are electrically discontinuous, and a switch connected to one of the two contact points, whereas the connective element comprises a projection, the position of which matches that of the switch. Thus, as an ink container is mounted, the projection presses the switch, causing the switch to contact the other contact point. As a result, the electrically open portion becomes continuous.

The electrically open portion may be structured as follows: It comprises a pair of contact points which are electrically discontinuous, whereas the connective element comprises a connective wire, the ends of which match in position to the pair of contact points of the electrically open portion. Thus, as an ink container is mounted, the ends of the connective wire come into contact with the two contact points of the electrically open portion, one for one. As a result, the electrically open portion becomes continuous. In the case of this set-up, the two contact points and the end portions of the connective wire may be structured so that they couple with each other.

The recording apparatus in accordance with the present invention employs the above described recording head cartridge. It detects whether or not the recording head has been fitted with a given ink container, based on whether or not the electrically open portion has been made continuous. Further, it may be designed so that when the electrically open portion is remaining discontinuous, the operation for restoring the recording head performance will not be carried out.

The recording head chip in accordance with the present invention employs an ink jet recording chip, which ejects ink by being driven by the driving voltage supplied through the driving voltage transmission line, and the electrical signal supplied through the electrical signal transmission line. It removably supports a single or multiple ink containers for supplying ink to the ink jet recording chip having the connective element. At least one of the driving voltage transmission line and electrical signal transmission line is provided with the electrically open portion, the position of which corresponds to that of the connective element, and as the ink container is mounted, the electrically open portion is closed by the connective element.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. The ink jet recording apparatuses in the following embodiments of the present invention are characterized by their ink jet recording heads and ink containers. The structures of the other portions of the ink jet recording apparatuses are the same as those of the ink jet recording apparatus in accordance with the prior art.

Figure 1:
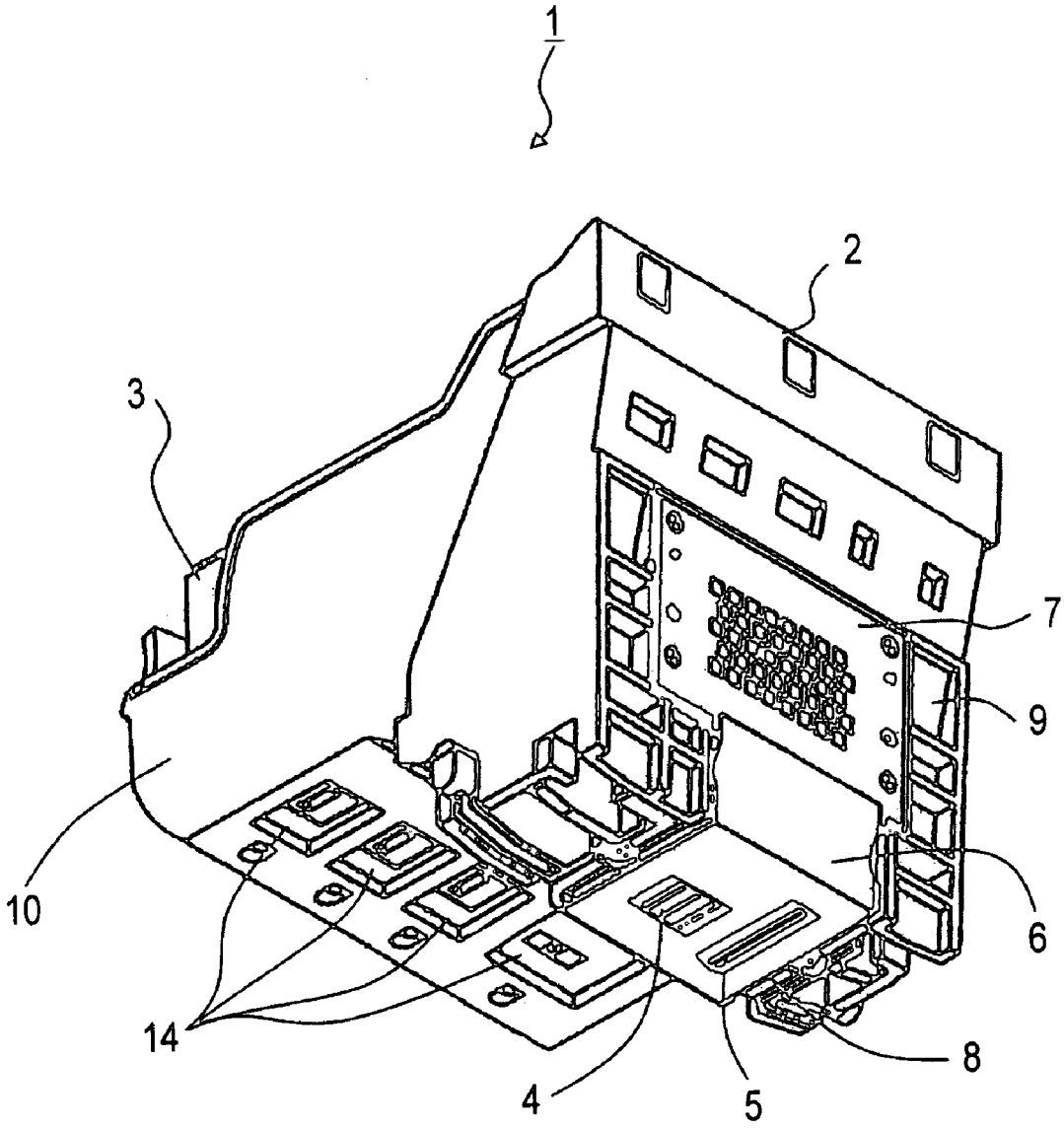
FIG. 1 is a schematic perspective view of the recording head cartridge in the first embodiment of the present invention.
Figure 13:
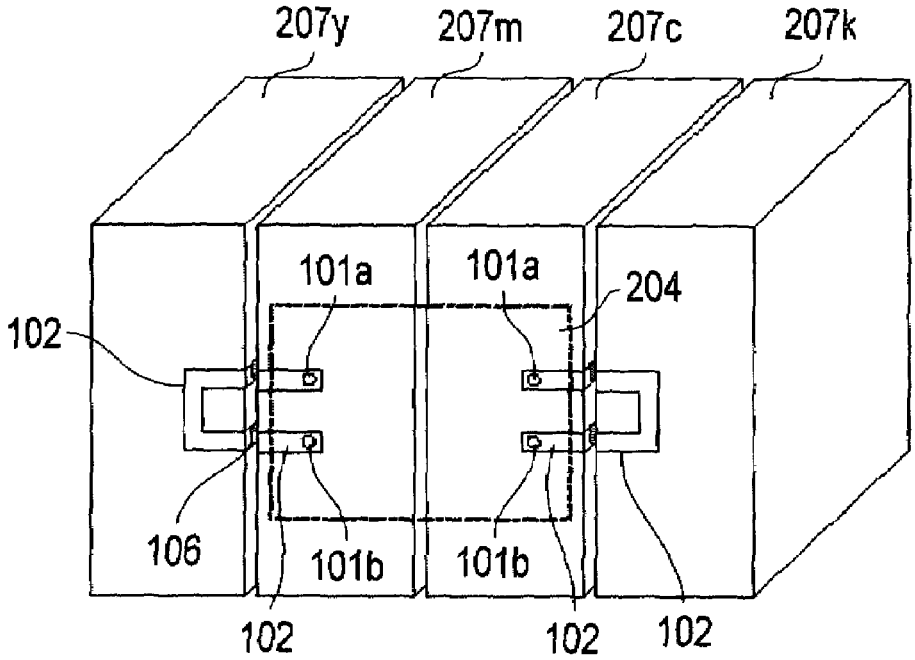
FIG. 13 is a perspective view of the ink containers, electrical wires placed on the ink containers, electrical wires placed on the ink jet recording head, and contact portions thereof, in the seventh embodiment of the present invention.

FIG. 1 is a perspective view of the recording head cartridge in the first embodiment of the present invention. The recording head cartridge 1 has an ink jet recording head (which hereinafter will be referred to as recording head) 2, and an ink container 3. The recording head 2 is provided with a pair of ink jet recording chips 4 and 5, which are on the surface of the recording head 2, which faces the recording medium P (FIG. 13). The recording chip 4 is a color ink chip, and has a line of cyan ink ejection orifices, a line of magenta ink ejecting orifices, and a line of yellow ink ejecting orifices, whereas the recording chip 5 is a black ink chip having a line of black ink ejecting orifices. The two recording chips 4 an 5 are independently placed.

The ink jet recording chips 4 and 5 are driven by the electrical signals and driving voltage sent from the main assembly (unshown) of the recording apparatus. They have a heater board (unshown), ink ejection orifices (unshown), and a nozzle plate (unshown). The heater board has multiple electrothermal transducing elements for causing the ink to boil. The ink ejection orifices are the orifices through which ink droplets are ejected by the pressure generated by the boiling of the ink. The nozzle plate has ink passages (unshown) through which ink is supplied to the ink ejection orifices. The ink jet recording chips 4 and 5 are connected to a contact circuit board 7 having electrical contacts through which the chips 4 and 5 are electrically connected to the main assembly of a recording apparatus, through an electrical wire tape 6 having the electrical signal transmission wires for supplying the chips 4 and 5 with the electrical signals from the main assembly, and the driving voltage transmission wires for supplying the chips 4 and 5 with the driving voltage from the main assembly.

The recording chips 4 and 5 are precisely and solidly attached to a base board 8, which has ink passages through which the recording chips 4 and 5 are supplied with the ink from an ink container unit 3. The contact circuit board 7, electrical wire tap 6, and base board 8 are solidly attached to a supporting member 9, which also has ink passages through which ink is supplied from the ink container unit 3 to the ink jet recording chips 4 and 5, and a filter (unshown) for removing foreign particles from the ink supplied from the ink container unit 3. A part of the supporting member 9 constitutes an ink container holder 10 into which the ink container unit 3 is mounted. The bottom wall of the ink container holder 10 is provided with holes through which the prisms 14 of the ink containers of the ink container unit 3 are exposed to detect the amount of the ink remainder, or presence (absence) of the ink, in the ink containers of the ink container unit 3, based on the phenomenon that the reflection of a beam of light projected into the ink containers of the ink container unit 3 from the photosensors on the main assembly side of the recording apparatus is affected by the amount of the ink in the ink containers.

The ink jet recording apparatuses in the preferred embodiments of the present invention are made up of the main assembly and recording head cartridge. The main assembly of the recording apparatus described in this specification does not include the recording head cartridge. Although the ink container units 3 in the preferred embodiments of the present invention are structured so that they are mounted in a part of the recording head 3, they may be structured so that they are supported by the carriage 5 (FIG. 13) of the main assembly. Further, the recording heads 2 in the preferred embodiments are structured so that they can be removably mounted into the main assembly. However, they may be structured to be an integral part of the main assembly.

Figure 2:
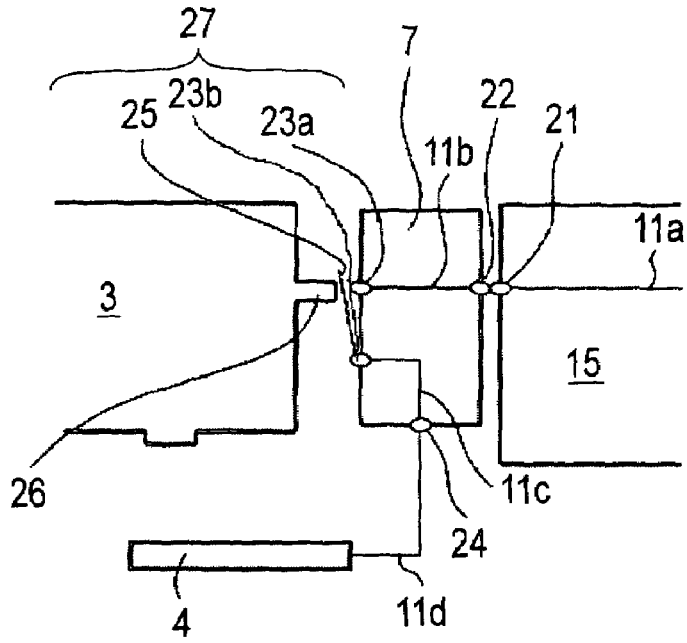
FIG. 2 is a schematic drawing for describing the principle for preventing the malfunction of the ink jet recording chip of the recording head cartridge in FIG. 1.
Figure 2:
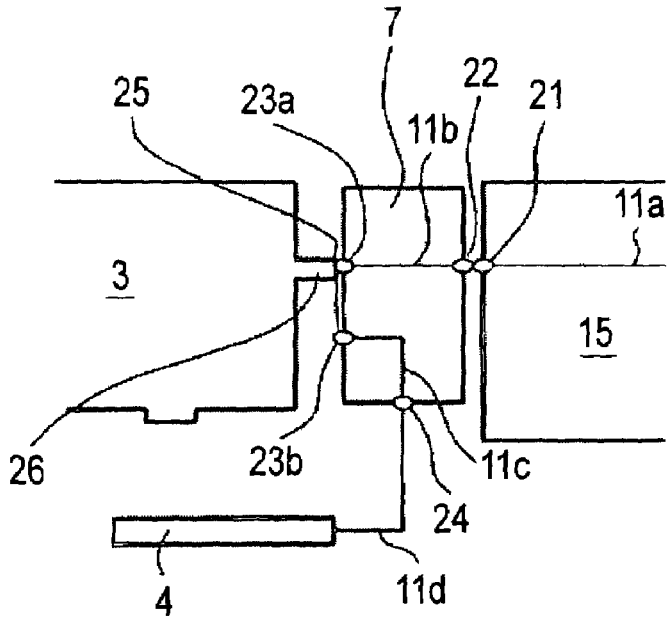

FIG. 2 is a schematic drawing showing the electrical signal transmission line from the main assembly of the recording apparatus to the ink jet recording chip. FIG. 2(*a*) shows the state of the electrical signal transmission line when the ink container unit 3 is not in the ink container holder, and FIG. 2(*b*) shows the state of the line when the ink container unit 3 is in the ink container holder. Hereinafter, the present invention will be described with reference to one of the color ink containers (case in which ink jet recording chip 4 is driven).

Referring to FIG. 2(*a*), the electrical signal transmission line 11 through which the electrical signals sent from the main assembly 15 of the recording apparatus are transmitted has three separate electrical wire portions 11*a*, 11*b*, 11*c*, and 11*d*. The electrical wire portion 11*a* is extended, within the main assembly 15 of the image forming apparatus, from the control portion (unshown) of the main assembly 15 to the contact point 21, by which the portion 11*a* is connected to the contact point 22 of the contact circuit board 7. The electrical wire portion 11*b* is extended from the contact point 22 of the contact circuit board 7 to the contact point 23*a* of the contact circuit board 7, which is on the surface of the contact circuit board 7 facing the ink container unit 3. The electrical wire portion 11*c* is extended from the contact point 23*b* of the contact circuit board 7, which is on the surface of the contact circuit board 7 facing the ink container unit 3, to the contact 24 of the contact circuit board 7 on the ink jet recording chip side. The electrical wire portion 11*d* is extended from the contact point 24 to the ink jet recording chip 4. The contact point 23*b* is connected to a switch 25. Sometimes, the combination of the contact points 23*a* and 23*b* and switch 25 may be referred to as electrically open portion.

The ink container unit 3 is provided with a projection 26, which is on the surface facing the switch 25. The projection 26 is a portion for closing (connecting) the electrically open portion, as will be described later. It may be structured so that it also functions as a projection for precisely positioning the ink container unit 3 relative to the ink container holder 10 when the ink container unit 3 is anchored to the holder 10. It is not in contact with the switch 25, and the switch 25 is not in contact with the contact point 23*a*. It should be noted here that when the recording head 2 is integral with the main assembly 15 of the image forming apparatus, the contacts 21 and 22 are unnecessary.

Next, referring to FIG. 2(*b*), what occurs as the ink container unit 3 is mounted into the ink container holder 10 will be described. As the ink container unit 3 is placed in the predetermined position in the ink container holder 10, the projection 26 of the ink container unit 3 presses the switch 25, causing the switch 25 to come into contact with the contact point 23*a*, electrically connecting the contact points 23*a* and 23. As a result, the electrical connection is established from the control portion of the main assembly 15 of the recording apparatus to the ink jet recording chip 4 through the electrical signal transmission line 11 inclusive of the contact points 21, 22, 23*a*, 23*b*, and 24.

Figure 3:
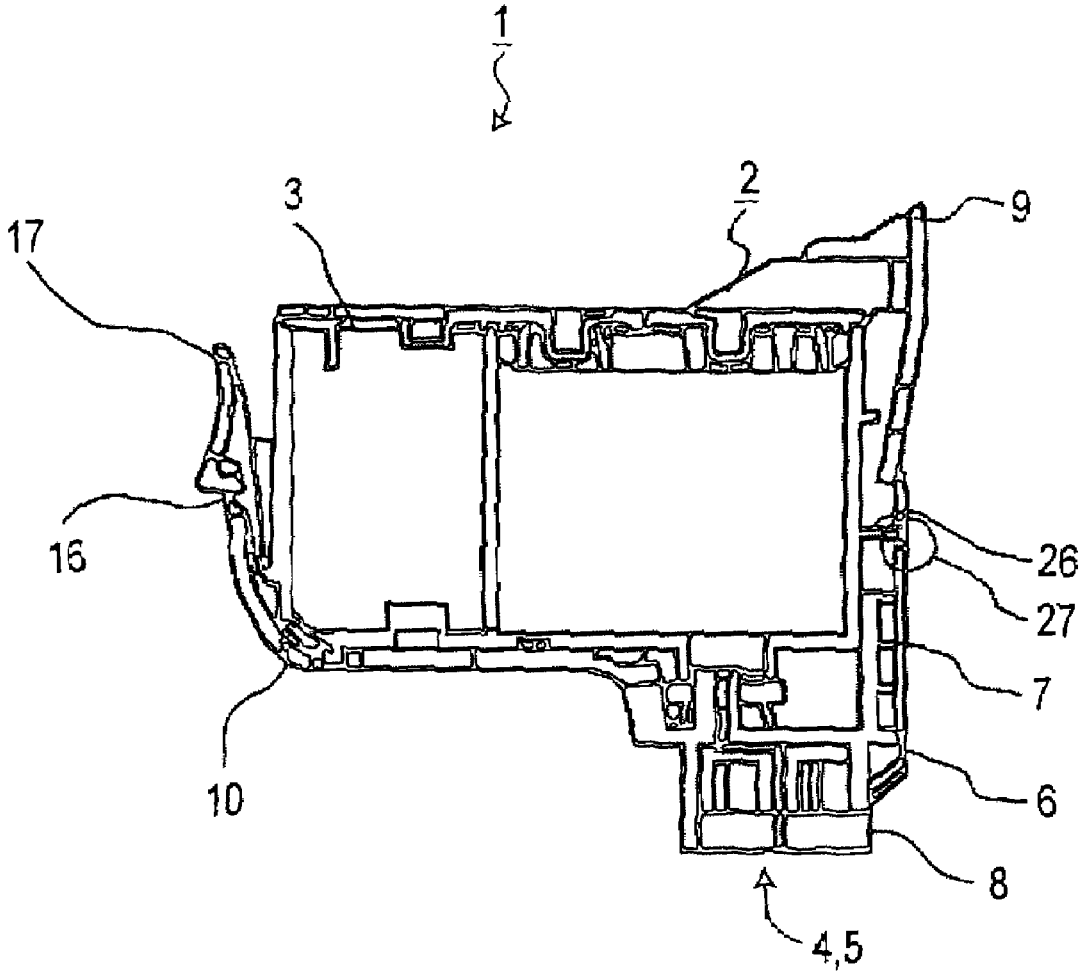
FIG. 3 is a sectional view of the recording head cartridge at a plane parallel to the side wall of thereof.

FIG. 3 is a sectional view of the recording head cartridge, at a plane parallel to the side wall thereof, when the ink container unit 3 is in the ink container holder 10. This drawing is the sectional view of one of the ink containers of the ink container unit 3 in the recording apparatus, and the sectional views of the other ink containers are the same as FIG. 3. As the ink container unit 3 is inserted into the ink container holder 10, the projection 26 enters the hole of the supporting member 9, and a latching lever 17 engages with the projection 16 of the ink container unit 3. As a result, the ink container unit 3 is held to the contact circuit board 7 by the resiliency of the latching lever 17, and the projection 23 is put through the hole of the supporting member 9, pressing the switch 25 (FIG. 4) attached to the contact circuit board 7 located on the outward side of the ink container holder 10.

Figure 4:
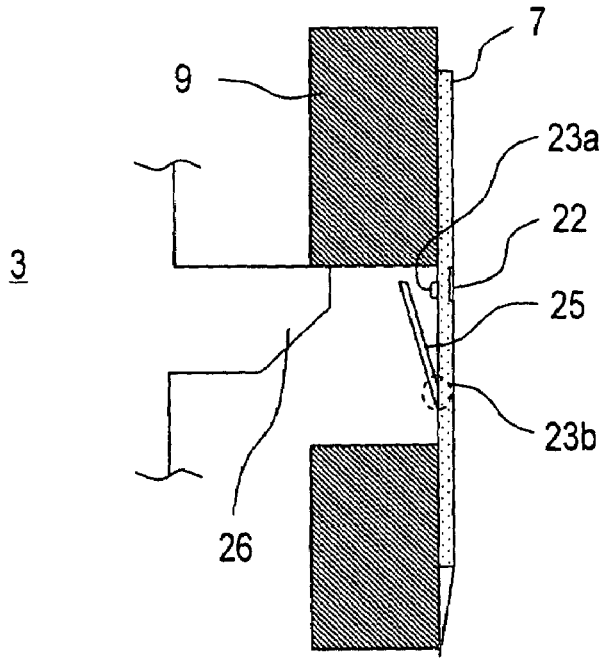
FIG. 4 is a sectional view of the electrically open (discontinuous) portion of the recording head, and its adjacencies, in FIG. 1.
Figure 4:
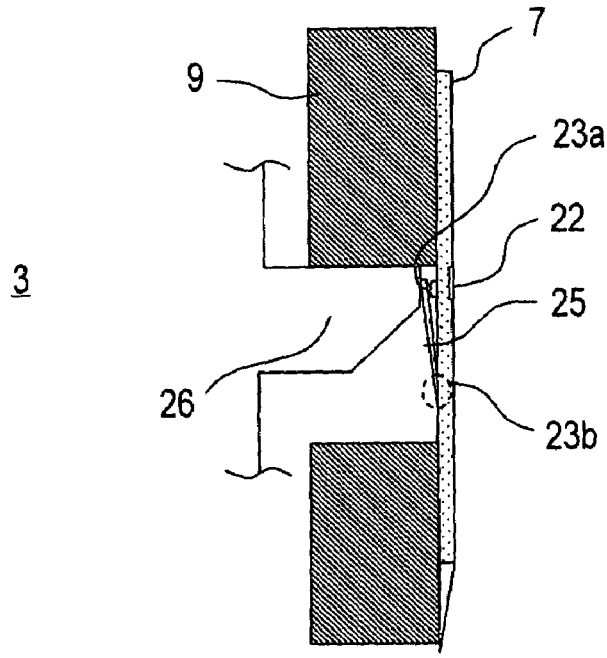

FIG. 4 is a schematic sectional view of the electrically open portion of the electrical signal transmission line 11 indicated by a circle in FIG. 3. FIG. 4(*a*) shows the electrically open portion in the open state, and FIG. 4(*b*) shows the electrically open portion in the closed state.

Referring to FIG. 4(*a*), the contact circuit board 7 is connected to the contact point 21 (FIG. 2) of the main assembly 15 of the recording apparatus through the contact 22 of the contact circuit board 7, being enabled to receive the electrical signals necessary to eject ink from the ink jet recording chip 4. The contact circuit board 7 is supported by the supporting member 9, and has the contact points 23*a* and 23*b* and switch 25, which are on the surface of the contact circuit board 7, which faces the ink container unit 3. The switch 25 is attached to the contact point 23*b*. Here, the contact point 23*b* means the point of the electrical signal transmission line 11 to which the switch 25 is attached. The switch 25 is formed of electrically conductive and elastic substance, and is structured so that unless external force is applied thereto, it will not come into contact with the contact point 23*a*. Thus, before the mounting of the ink container 3 into the ink container holder 10, the switch 25 is not in contact with the contact point 23*a*.

Next, referring to FIG. 4(*b*), as the ink container unit 3 is mounted into the ink container holder 10, the projection 23 presses the switch 25, causing the switch 25 to come into contact with the contact point 23*a*. As a result, it is made possible, for the first time, for electrical signals to be sent from the main assembly 15 of the image forming apparatus to the ink jet recording chip 4, through the contact circuit board 7 to drive the electrothermal transducing elements.

Therefore, if an attempt is made to drive the recording head 2 while the ink container unit 3 is not properly positioned in the ink container holder 10, the electrical signals outputted from the main assembly 15 of the recording apparatus are not allowed to reach the ink jet recording chip 4, preventing thereby the electrothermal transducing elements from being driven while ink is not supplied thereto. Therefore, it is possible to provide a combination of an ink jet recording apparatus, an ink jet recording head, and an ink container, which is highly reliable in that the ink ingredients are unlikely to be baked onto the electrothermal transducing elements of the ink jet recording head.

Incidentally, in the above, the present invention was described with reference to the electrical signal transmission line. However, the present invention is also applicable to the driving voltage transmission line just as effectively as it is applicable to the electrical signal transmission line. Further, the present invention is also compatible with an ink container for containing black ink. In the case that the present invention is applied to the electrical voltage transmission line, in order to make it possible to detect the presence (or absence) of the ink container unit 3 without the provision of a sensor dedicated to the detection of the presence (or absence) of the ink container unit 3, the main assembly 15 of the image forming apparatus may be provided with the circuit for detecting whether or not the recording head 2 is being supplied with the power source voltage during the preliminary ejection.

Figure 5:
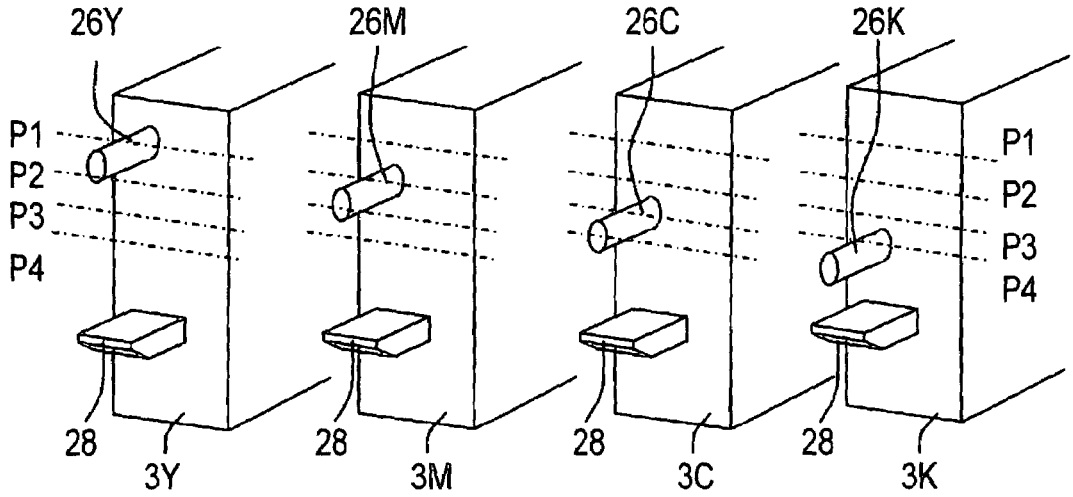
FIG. 5 is a schematic perspective view of the portion of the ink container of the recording head cartridge, which is to face the contact circuit board, showing the general configurations thereof.

FIG. 5 is a schematic perspective view of the ink container of the recording head cartridge in the second embodiment of the present invention. This drawing shows the surface of the ink container, which faces the contact circuit board 7. The ink container unit 3 has four ink containers 3Y, 3M, 3C, and 3K, in which yellow, magenta, cyan, and black inks are stored, respectively. Each of the four ink containers 3Y, 3M, 3C, and 3K has a connective projection 28, by which each ink container is precisely positioned relative to the recording head 2. The four ink containers 3Y, 3M, 3C, and 3K are identical in the position and configuration of the connective projection 28. Further, the four ink containers 3Y, 3M, 3C, and 3K of the ink container unit 3 are provided with projections 26Y, 26M, 26C, and 26K, respectively, which are different in the position relative to the ink container which they belong (positions P1-P4).

Figure 6:
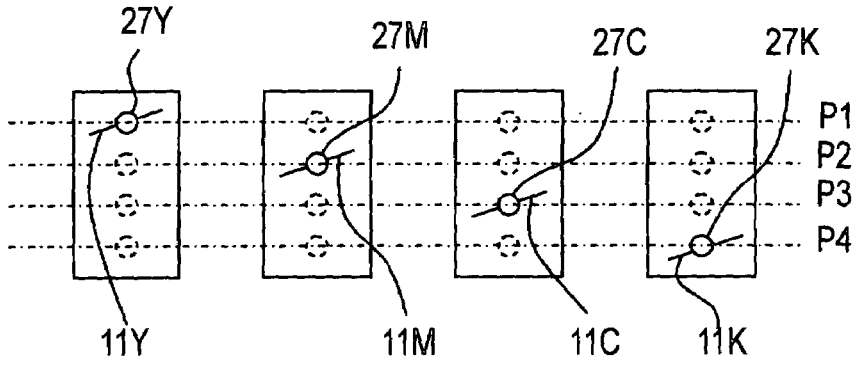
FIG. 6 is a schematic plan view of the portion of the ink container of the recording head cartridge, which is to face the contact circuit board, showing the general configuration thereof.

FIG. 6 is a schematic plan view of the surface of the contact circuit board 7, which is to face the ink container unit 3. The contact circuit board 7 is provided with electrically open (discontinuous) portions 27Y, 27M, 27C, and 27K, which are circled with solid lines in the drawing, and the positions of which correspond to those of the projections 26Y, 26M, 26C, and 26K of the ink containers of the ink container unit 3, respectively. The electrically open portions 27Y, 27M, 27C, and 27K are connected to the electrical signal transmission wires portions 11Y, 11M, 11C, and 11K, respectively. However, before the ink container unit 3 is mounted into the ink container holder 10, the electrically open portions 27Y, 27M, 27C, and 27K remain literally open, keeping the electrical signal transmission line remain discontinuous. Therefore, there is no electrical connection between the main assembly 15 of the image forming apparatus and ink jet recording chip 4. The portions circled by broken lines on each of the contact circuit boards 7 in FIG. 6 show the comparative positions of the projections of other contact circuit boards 7; no electrically open portion is present on the portion circled by the broken lines. Further, the portions correspondent to the connective projections 28 are not illustrated in FIG. 6.

As an ink container is mounted in the correct position, for example, as an ink container containing yellow ink is connected to the yellow ink ejecting portion of the ink jet recording chip 4, the electrically open portion 27Y is closed, electrically connecting the ink jet recording chip 4 to the main assembly 15 of the control portion of the main assembly 15 of the image forming apparatus through the electrical signal transmission line 11Y, enabling thereby the yellow ink ejection portion of the ink jet recording chip 4 to be driven. However, if an ink container is mounted in an incorrect position, that is, as the ink container 3M is mounted in the position for the ink container 3Y, the projection 26M is not allowed to close the electrically open portion 27Y. Therefore, no electrical connection is established between the ink jet recording chip 4 and the control portion of the main assembly 15. Although, in the above, the present invention was described with reference to the electrical signal transmission line, the present invention is just as effectively applicable to the driving voltage transmission line as it is applicable to the electrical signal transmission line.

Incidentally, the projections 26Y, 26M, 26C, and 26K are substantially different in the position relative to the ink container to which each of them belongs. However, when there is a spatial restriction in terms of the positioning of the electrical wires, their positions may be varied within a range in which the electrically open portions do not malfunction. Further, an ink container is generally molded with the use of a metallic mold. Thus, molding all ink containers with all projections 26Y, 26M, 26C, and 26K, and removing the unnecessary projections from each ink container according to the color of the ink for which the ink container is intended, eliminates the need for preparing multiple molds different in configuration, making it possible to reduce an ink container in manufacturing cost.

As will be evident from the above description of the structural arrangement in accordance with the present invention, if a given ink container is placed in the wrong position in the ink container holder 10 when it is mounted into the ink container holder 10, the electrical signals and power source are not supplied to the ink jet recording chips from the main assembly 15 of the recording apparatus, making it simple for a user to realize that the given ink container has not been mounted, or that an ink container containing wrong ink has been mounted. Therefore, even in the case of an ink jet recording apparatus employing multiple recording heads different in driving condition (specification), the recording head and ink jet recording chips are not adversely affected. Moreover, an ink jet recording apparatus may be structured so that if an ink container is mounted into the wrong position, the performance recovery operation cannot be carried out. Such an arrangement can minimize the extent of the ink mixture within a recording head, making it possible to provide a combination of an ink jet recording apparatus, an ink jet recording head, and an ink container, which are even higher in reliability.

Figure 7:
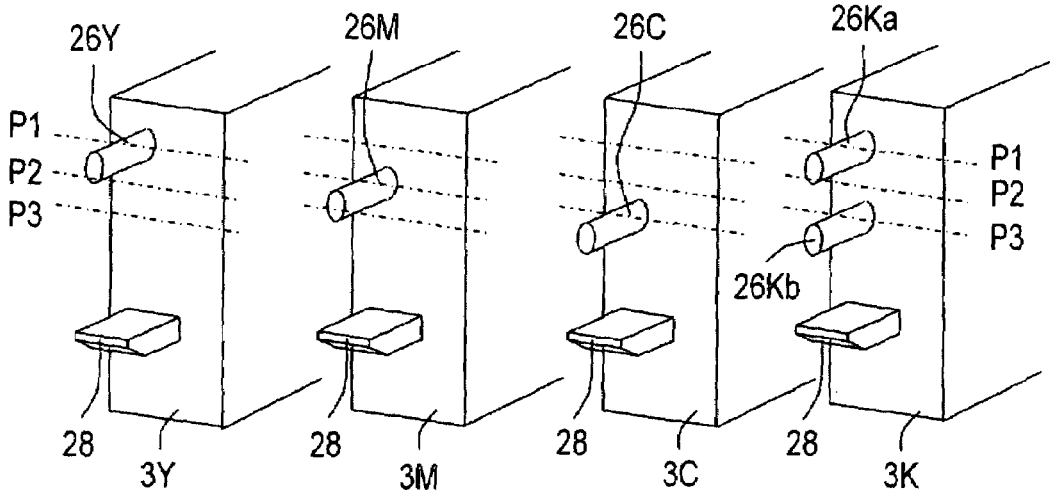
FIG. 7 is a schematic perspective view of the portion of the ink container of the recording head cartridge, in the second embodiment, which is to face the contact circuit board, showing the general configuration thereof.
Figure 8:
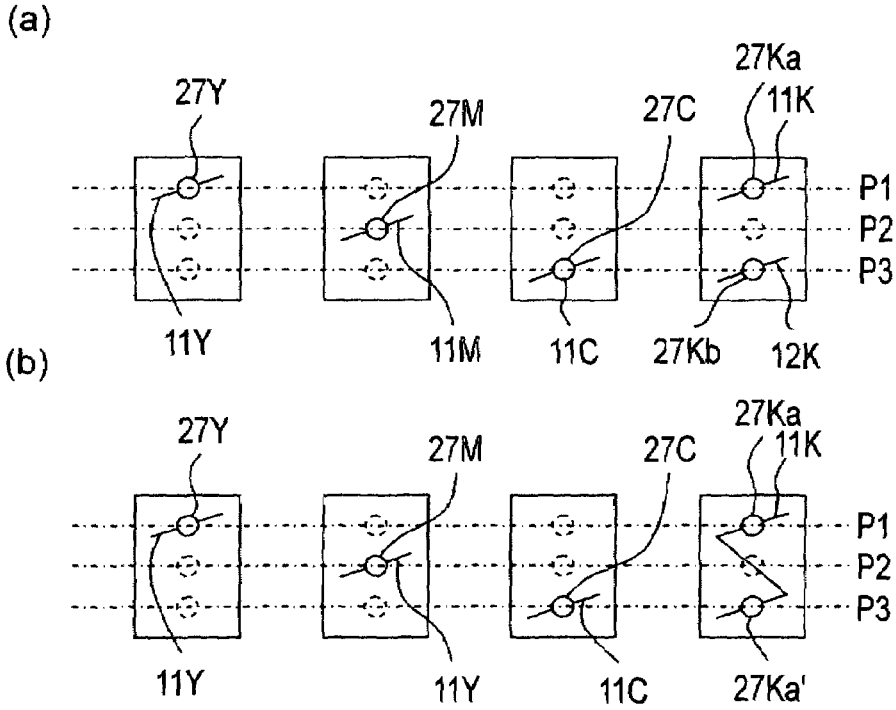
FIG. 8 is a schematic plan view of the portion of the ink container of the recording head cartridge, in the second and third embodiments, which is to face the contact circuit board, showing the general configuration thereof.

FIG. 7 is schematic sectional view of the ink container of the recording head cartridge in the third embodiment of the present invention. FIG. 8(*a*) is a schematic plan view of the surface of the contact circuit board, which is to face an ink container. In FIG. 8(*a*), the portion of the contact circuit board, which corresponds to the connective projection 28 shown in FIG. 7, is not shown, and what are meant by the circles drawn by solid lines and broken lines are the same as in FIG. 6.

This embodiment is different from the second embodiment in that the black ink container 3K is provided with two projections 26Ka and 26Kb, and also, that both the signal transmission line and driving voltage transmission line of the contact circuit board 7 of only the black ink container 3K are provided with the electrically open portion.

The portions of the contact circuit board 7, which correspond in position to the projections 26Y, 26M, and 26C of the ink container unit 3, are provided with the electrically open portions 27Y, 27M, and 27C, respectively. The electrically open portion 27Ka is located at a position P1, and electrically open position 27Kb is located at a position P3 (their positions may be reversed). The electrically open portions 27Ka and 27Kb correspond to the electrical signal transmission line 11K, and driving voltage transmission line 12K, respectively (they may be made to correspond in reverse). Before the mounting of a given ink container into the ink container holder 10, the electrical signal transmission lines 11Y, 11M, and 11C are prevented by the electrically open portions 27Y, 27M, and 27C, respectively, from transmitting electrical signals, whereas the driving voltage transmission line 12K is prevented by the electrically open portion 27Kb from transmitting driving voltage. As for the positions of the projections 26Ka and 26Kb, it is desired that two among the positions P1, P2, and P3 are selected, in consideration of the above described manufacturing method. However, the positions other than the positions P1, P2, and P3 may be selected. Further, the black ink container 3K may be left with all three projections.

With the employment of the above described structural arrangement, if an ink container other than the black ink container 3K is mounted into the position for the black ink container 3K, the ink in this ink container is not ejected from the ink jet recording chip 5 (black ink ejecting chip), because the ink jet recording chip 5 cannot be driven unless both the electrical signal transmission line 11K and driving voltage transmission line 12K are enabled to transmit electrical signals and driving voltage, respectively. Therefore, there is no possibility that the ink ingredients will be baked onto the electrothermal transducing elements, and therefore, there is no possibility that the recording head will be reduced in performance by the ingredients baked onto the electrothermal transducing elements.

Incidentally, the reason why it is set up so that unless both the electrical signal transmission line 11K and driving voltage transmission line 12K are rendered continuous, the electrothermal transducing elements cannot be driven is that if non-black ink enters the ink jet recording chip 5, which is different from the other ink jet recording chip in the driving condition, there is the possibility that the ingredients in the non-black ink will be baked onto the electrothermal transducing elements of the ink jet recording chip 5, reducing thereby the recording head in performance. Thus, if an ink jet recording apparatus is designed, for some reason, to employ an ink container which will have substantial adverse effects if it is mounted into a position not intended for this ink container, this ink container may be given the same structure as the above described one.

Further, when providing a given ink container with two projections 26, two switches may be serially placed in either the electrical signal transmission line or driving voltage transmission line, instead of assigning the two projections 26 to the electrical signal transmission line and driving voltage transmission line, one for one. FIG. 8(*b*) shows an example of such an structural arrangement. For example, the electrically open portion 27*a*, which corresponds to the electrical signal transmission line 11K is located at the position P1, and another electrically open portion 27*b*, which also corresponds to the electrical signal transmission line 11K, is located at the position P3, so that the two electrically open portions 27*a* and 27*b* are serially positioned in the electrical signal transmission line 11K. With the employment of such a structural arrangement, the electrical signal transmission line 11K does not become continuous, unless both the electrically open portions 27*a* and 27*b* are closed. Therefore, this structural arrangement is more reliable than the above described arrangement.

By changing the number of the projections, and/or switching the projections in position and/or combination, it is possible to provide a combination of an ink jet recording apparatus, an ink jet recording head, and an ink container, which is highly reliable in that the problem that the ink ingredients are abnormally baked onto the electrothermal transducing elements, or the like problem, does not occur, and also, it is possible to rationalize the manufacturing process.

Figure 9:
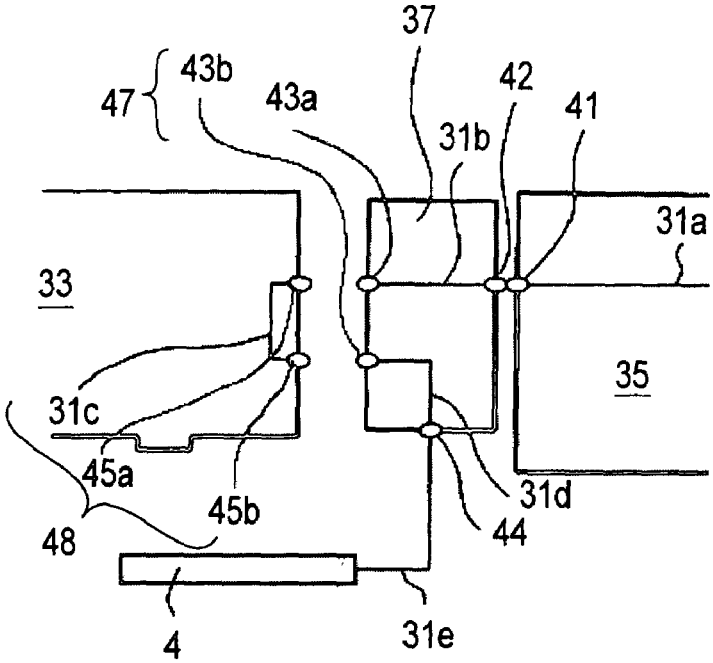
FIG. 9 is a schematic drawing for describing the principle for preventing the malfunction of the ink jet recording chip of the recording head cartridge in the fourth embodiment of the present invention.
Figure 9:
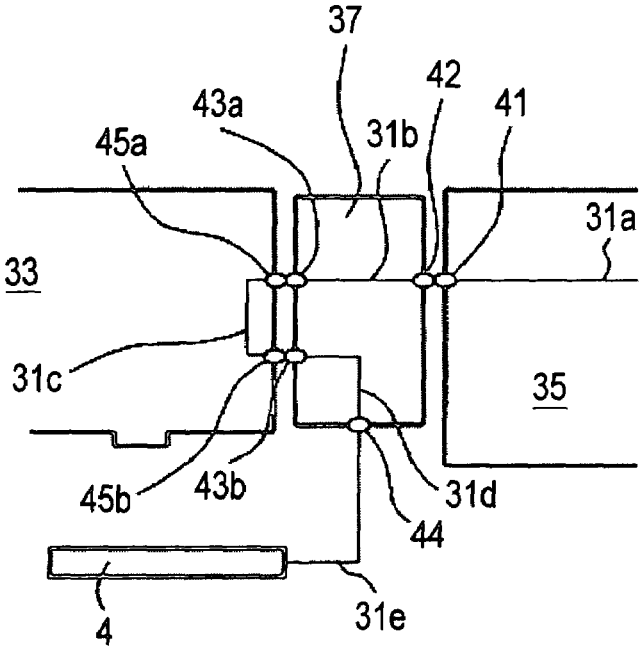

FIG. 9 is a schematic drawing of the portion of the electrical signal transmission line of the recording head portion of the ink jet recording apparatus, between the main assembly of the recording apparatus and one of the ink jet recording chips, in the fourth embodiment of the present invention. The fourth embodiment is different from the first embodiment in that a part of the electrical signal transmission line is placed on the ink container.

FIGS. 9(*a*) and 9(*b*) show the states of the electrical signal transmission line before and after, respectively, the ink container is mounted into the ink container holder. Here, the present invention will be described with reference to the electrical signal transmission line.

Referring to FIG. 9(*a*), the electrical signal transmission line 31 through which the electrical signals sent from the main assembly 35 of the recording apparatus are transmitted has four separate electrical wire portions 31*a*, 31*b*, 31*c*, and 31*d*. The electrical wire portion 31*a* is extended, within the main assembly 35 of the image forming apparatus, from the control portion (unshown) of the main assembly 35 to the contact point 41, by which the electrical wire portion 31*a* is connected to the contact point 41 of the contact circuit board 37. The electrical wire portion 31*b* is extended from the contact point 42 of the contact circuit board 37 to the contact point 43*a* of the contact circuit board 37, which is on the surface of the contact circuit board 37 facing the ink container unit 3. The electrical wire portion 31*d* is extended from the contact point 43*b*, on the surface of the contact circuit board 37 facing the ink container 33, to the contact point 44 on the ink jet recording chip 4 side. The contact point 31*e* is extended from the contact point 44 to the ink jet recording chip 4. The ink container 33 is provided with a pair of contact points 45*a* and 45*b*, which are on the surface facing the contact circuit board 37, being positioned so that they come into contact with the contact points 43*a* and 34*b* as the ink container 33 is mounted. The ink container 33 is also provided with an electrical wire portion 31*c*, which is connecting the contact points 45*a* and 45*b*. The combination of the contact points 43*a* and 43*b* may sometimes be referred to as electrically open portion, whereas the combination of the contact points 45*a* and 45*b* and electrical wire portion 31*c* may be referred to as connective element 48.

Before the mounting of the ink container 33, the contact points 45*a* and 45*b* are not in contact with the contact points 43*a* and 43*b*, respectively. Therefore, the electrical signal transmission line 31 is not continuous. As the ink container 33 is mounted, the contact points 45*a* and 45*b* come into contact with the contact points 43*a* and 43*b*, respectively, the electrical signal transmission line 31 becomes continuous as it does in the first embodiment.

Figure 10:
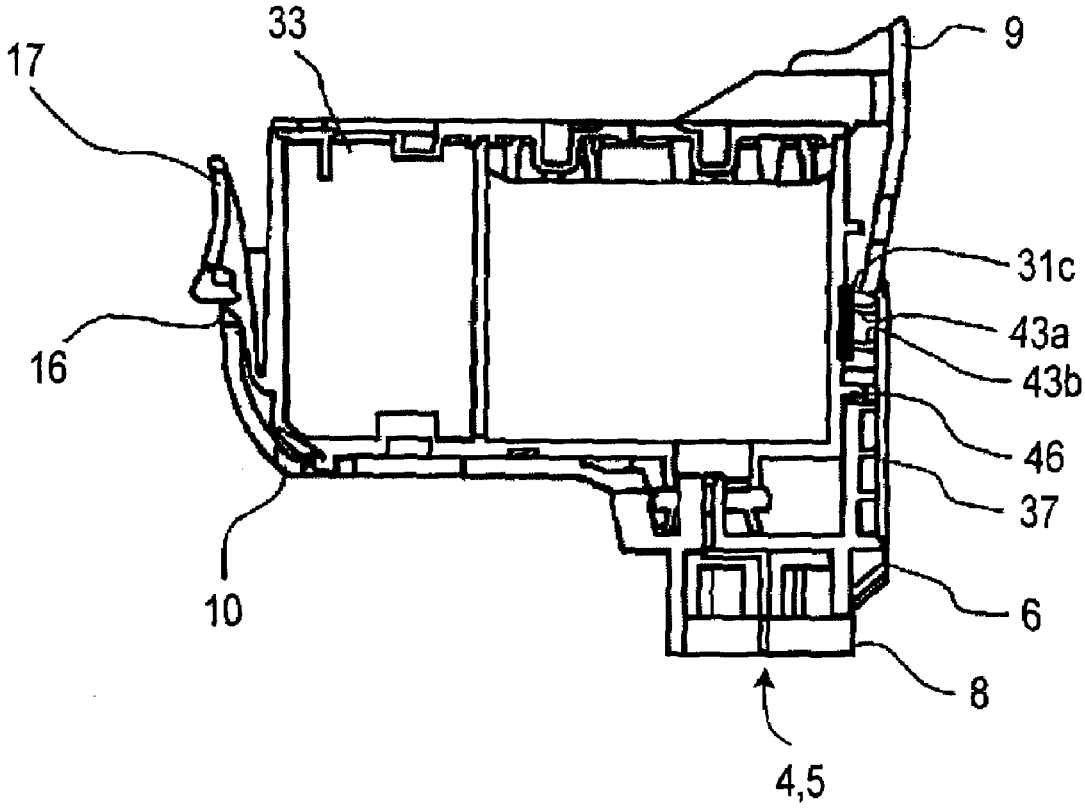
FIG. 10 is a sectional view of the recording head cartridge in FIG. 9, at a plane parallel to one of the side walls thereof.

FIG. 10 is a sectional view of the recording head cartridge, at a plane parallel to the side walls thereof, after the mounting of the ink container 33. The contact circuit board 37 fixed to the supporting member 9 is provided with the contact points 43*a* and 43*b* of the electrical signal transmission line 31 through which the electrical signals are sent to the ink jet recording chip 4. The contact points 43*a* and 43*b* are on the back side of the contact circuit board 37. Although FIG. 10 is the sectional view of only one of the ink containers 33, the other ink containers 33 are the same as the ones shown in FIG. 10, in terms of the contact points of the electrical signal transmission line 31. In this embodiment, the contact points 43*a* and 43*b* are placed on the contact circuit board 37. However, the locations of the contacts 43*a* and 43*b* do not need to be limited to those in this embodiment. For example, they may be placed on the electrical wire tape 6. As the ink container 33 is inserted into the ink container holder 10, a locking claw 46 is put through the hole of the supporting member 9, causing the latching lever 17 to engage with the projection 16. As a result, the ink container unit 3 is held to the contact circuit board 7 by the resiliency of the latching lever 17.

The electrical signal transmission line 31 is discontinuous between the contact points 43*a* and 43*b*. The ink container 33 has the electrical wire portion 31*c* as a part of the electrical signal transmission line 31. Thus, as the ink container 33 is mounted into the ink container holder 10, the electrical wire portion 31*c* comes into contact with the contacts 34*a* and 43*b* through the contact 45*a* and 45*b*, allowing electrical signals to be sent from the main assembly 35 of the recording apparatus to the ink jet recording chip 4 to drive the electrothermal transducing elements.

The contact points 43*a* and 43*b*, and the contact points 45*a* and 45*b*, are structured so that they can be coupled with to each other. For example, the contact point 43*a* may be in the form of a projection, whereas the contact point 45*a* may be in the form of a recess, as shown in FIG. 10.

The electrical wire portion 31*c* is formed of electrically conductive metal, and is integrally formed with the ink container 33 by two color molding when the ink container 33 is molded of resin. The use of two color molding makes it possible to eliminate the labor required to attach the electrical wire portion 31*c* to the ink container 33. Incidentally, when it is necessary to provide the ink container 33 with a certain amount of strength, the ink container itself, or the external reinforcement jacket therefor, may be formed of electrically conductive metal of high strength. In such a case, the ink container itself can be used as a part of the electrical wire portion 31*c*. Obviously, the electrical wire portion 31*c* may be pasted to the external jacket of the ink container 33.

As described, with the employment of the above described structural arrangement, if it is attempted to drive the recording head without fitting the recording head with the ink container 33, the electrical signals outputted from the main assembly 35 of the recording apparatus cannot be sent to the ink jet recording chip 4. Therefore, it is possible to prevent the electrothermal transducing elements from being driven when ink is not in the ink jet recording head. Thus, it is possible to provide a combination of an ink jet recording apparatus, an ink jet recording head, and an ink container, which is highly reliable in that there is no possibility that ink ingredients will be baked onto the electrothermal transducing elements by an excessive amount.

Although this embodiment of the present invention was described, in the above, with reference to the electrical signal transmission line, the effects of the application of the present invention to the driving voltage transmission line is the same as the effects of the above described application of the present invention to the electrical signal transmission wire. Further, although the above description of this embodiment of the present invention was made with reference to an ink container for containing color ink, the effects of the application of the present invention to an ink container for containing black ink is the same as the effects of the above described application of the present invention to the ink container for color ink. In the case of the driving voltage transmission wire, by providing the main assembly of the recording apparatus with a circuit for detecting whether or not the recording head is provided with the voltage from the power source during the preliminary ejection period, it is possible to detect the presence (absence) of the ink container without having a sensor dedicated to the detection of the presence (absence) of an ink container.

Figure 11:
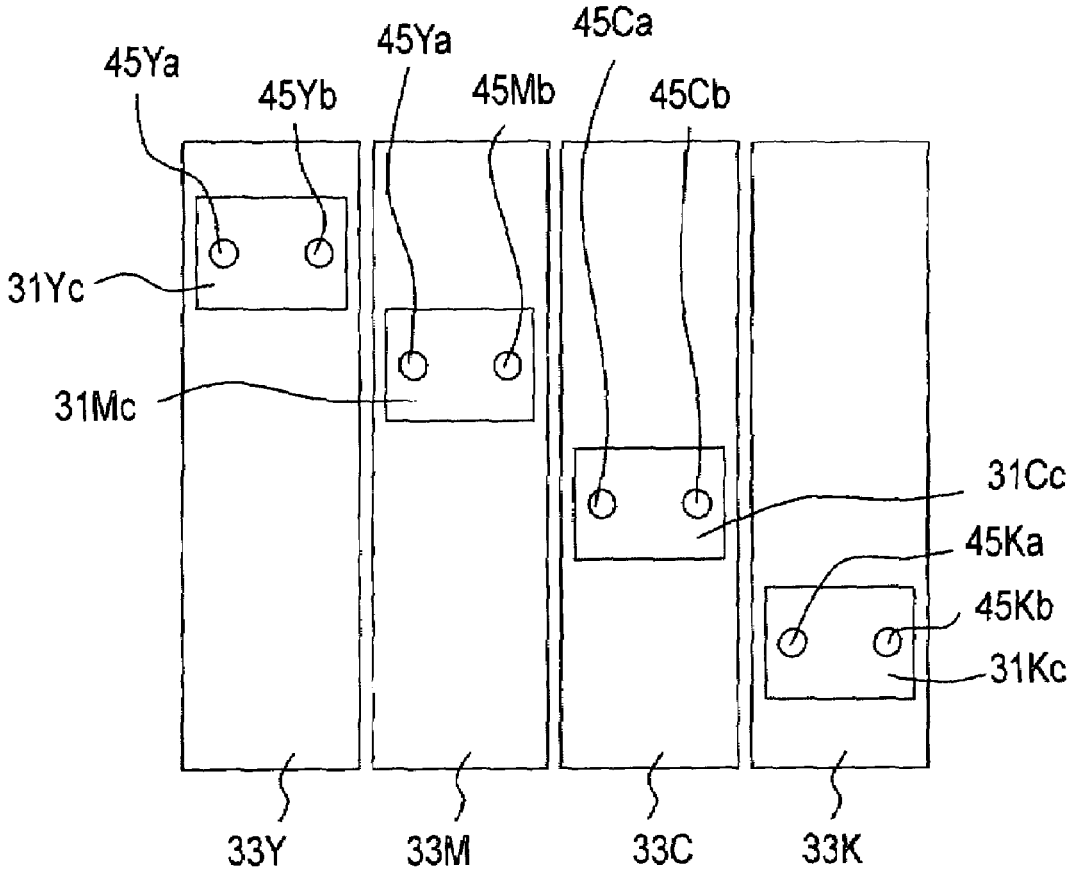
FIG. 11 is a schematic plan view of the portion of the ink container of the recording head cartridge, in the fifth embodiment, which is to face the contact circuit board, showing the general configuration thereof.

FIG. 11 is a conceptual drawing showing the electrically open (discontinuous) portion of the recording head cartridge in the fifth embodiment of the present invention. This drawing shows the relationship between the electrical signal transmission wire and its contact points, located on the surface of each ink container facing the contact circuit board. The ink container unit 33 has four ink containers 33Y, 33M, 33C, and 33K, which contain yellow, magenta, cyan, and black inks, respectively. The ink containers 33Y, 33M, 33C, and 33*k* are provided with electrical wire portions 31Yc, 31Mc, 31Cc, and 31Kc, which are on the surfaces thereof facing the contact circuit board, and the positional relationship of which relative to the ink containers to which they belong are differentiated based on the color of the ink they contain. The electrical wire portion 31Yc is provided with a pair of contact points 45Ya, and 45Yb. Similarly, the electrical wire portion 31Mc has a pair of contact points 45Ma and 45Mb; the electrical wire portion 31Cc, a pair of contact points 45Ca and 45Cb; and the electrical wire portion 31Kc is provided with a pair of contact points 43Ka and 43Kb. The surface of the contact circuit board facing the contact points 45Ya and 45Yb is provided with a pair of contact points 43Ya and 43Yb. In other words, the electrically open (discontinuous) portion 47Y and connective element 48Y are positioned so that they directly oppose each other. This set-up is the same in the case of the ink containers for other colors.

Before the mounting of the ink containers, the electrical signal transmission lines 31Y, 31M, 31C, and 31K are kept discontinuous by the electrically open portions 47Y, 47M, 47C, and 47K, respectively. As the ink container 33Y, for example, is mounted, the contact points 45Ya and 45Yb come into contact with the contact points 43Ya and 43Yb, respectively. In other words, the electrically open portion 47Y comes into contact with the connective element 48Y, making it possible to drive the yellow portion of the ink jet recording chip 4.

However, if an ink container, which is wrong in the color of the ink it contains, for example, an ink container 33M, is mounted into the position for the ink container 33Y, the electrically open portion 47Y does not contact with the connective element 48M. Therefore, the electrical signal transmission wire 31Y is not erroneously made continuous.

Incidentally, although, in the above, this embodiment of the present invention was described with reference to the electrical signal transmission line, the application of the present invention to the driving voltage transmission line yields the same effect as the above described effect yielded by the application of the present invention to the electrical signal transmission line, as they are in the fourth embodiment.

The four types of ink containers in this embodiment for four inks of different color, one for one, can be manufactured by pasting four connective elements 48Y, 48M, 48C, and 48K differentiated based on the color of the inks therein, to four identical base ink containers formed of resin. Therefore, only one type of metallic mold is necessary to manufacture the four types of ink containers, making it possible to easily manufacture the four types of ink containers while minimizing the ink container cost.

Further, not only can the erroneous mounting of an ink container can be prevented by varying the multiple (four) ink containers in the positions of the electrically open portion and connective element, but also, by varying the multiple (four) ink containers in configuration. In other words, even if the multiple (four) ink containers are identical in the positions of the electrically open portion and connective element, the problem that an ink container for ink of a given color is erroneously mounted into the position for an ink container for ink of another color can be prevented by varying the multiple sets of the electrically open portion and connective element in configuration as described above, for example, giving one set of the electrically open portion a circular shape, and second set a rectangular shape, and so on.

As described above, if an ink container is erroneously mounted into the position reserved for a specific ink container, the electrical signals and voltage from the main assembly of a recording apparatus are not supplied to an ink jet recording chip. Therefore, it can be easily detected whether or not a given ink container is in the ink container holder, and/or that an ink container is erroneously mounted into the position reserved for a specific ink container. Further, even in the case of an ink jet recording apparatus employing multiple recording heads different in driving condition (varied based on ink color), the recording head and ink jet recording chips are not adversely affected. Moreover, the combination of an ink jet recording apparatus, an ink jet recording head, and an ink container may be designed so that if an ink jet recording head is fitted with an incorrect ink container, it cannot be suctioned for performance recovery. Such a design can minimize the extent of the ink mixture in the recording head, making it possible to provide a combination of an ink jet recording apparatus, an ink jet recording head, and an ink container, which is even higher in reliability.

Figure 12:
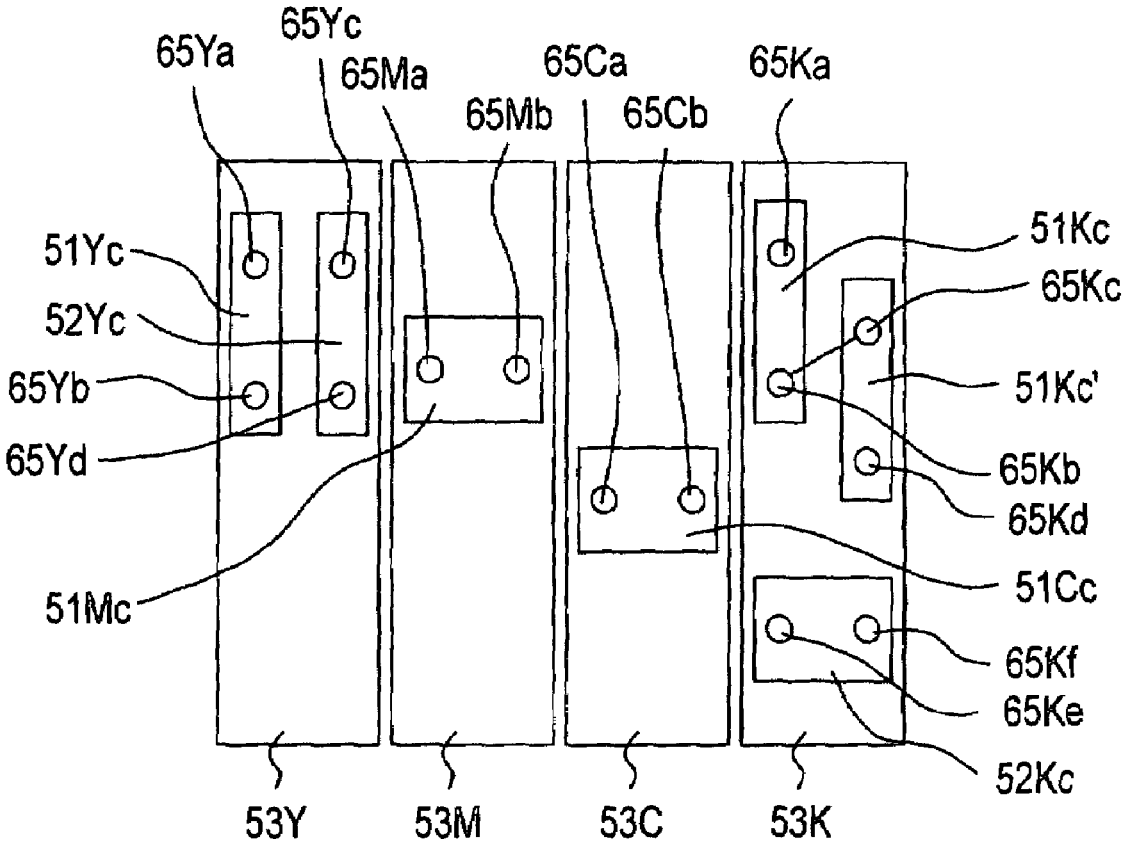
FIG. 12 is a schematic plan view of the portion of the ink container of the recording head cartridge, in the sixth embodiment, which is to face the contact circuit board, showing the general configuration thereof.

FIG. 12 is a conceptual drawing of the electrically open (discontinuous) portion and connective element of the recording head cartridge in the sixth embodiment of the present invention. This drawing shows the relationship between the electrical signal transmission line and the contact points thereof, placed on the surface of the ink container facing the contact circuit board, as does FIG. 11. The ink container unit 53 in this embodiment has four ink containers 53Y, 53M, 53C, and 53K containing yellow, magenta, cyan, and black inks, respectively, as does the ink container unit in the fifth embodiment. The ink container 53M is provided with an electrical wire portion 51Mc and a pair of contact points 65Ma and 65Mb, and the ink container 53C is provided with an electrical wire portion 51Yc and a pair of contact points 65Ya and 65Yb.

However, the ink container 53Y is provided with an electrical wire portion 52Yc of the electrical signal transmission line, and a pair of contact points 65Yc and 65Yd, in addition to an electrical wire portion 51Yc and a pair of contact points 65Ya and 65Yb. Therefore, the ink jet recording chip 4 does not function unless both the electrical signal transmission line and driving voltage transmission line of the ink container 53Y become continuous. In other words, this set-up further raises the level of reliability.

In addition, the ink container 53K is provided with a connective element made up of an electrical wire portion 51Kc and a pair of contact points 65Ka and 65Kb, of the driving voltage transmission line 51K, an a second connective element made up of an electrical wire portion 51Kc' and a pair of contact points 65Kc and 65Kd. Further, the contact points 65Kb and 65Kc are electrically connected to each other within the ink container 53K. In other words, the electrical wire portion 51Kc is provided with serially connected two connective elements. Further, the ink container 53K is provided with an electrical wire portion 53Kc and a pair of contact points 65Ke and 65Kf, of driving voltage transmission line. Therefore, the ink jet recording chip 5 does not function unless both the electrical signal transmission line and driving voltage transmission line of the ink jet recording head become continuous. Also, in order for the electrical signal transmission line 51K to become continuous, both of the two connective elements have to be placed in contact with the corresponding contact points. Thus, this setup further raises the level of reliability.

By not only providing the recording heads with electrically open (discontinuous) portions, but also, varying the ink containers in the configuration of electrical wires, number of electrically open portions, and position of the electrically open portion, as described above, it is possible to provide the combination of an ink jet recording apparatus and a recording head cartridge, which is even higher in reliability in that it does not malfunction.

In the preceding preferred embodiments of the present invention, in the case of an ink jet recording head which employs multiple ink containers, the electrical wires of all the ink containers, and the corresponding portions of the ink jet recording head, have to be provided with electrical contact points. Therefore, each electrical wire has to be made wide enough, at least at one end, to reliably come into contact with the corresponding portions of the ink container. However, widening the electrical wires as described above results in the increase in the electrical wire cost.

FIG. 13 is a schematic drawing showing the relationship among the ink containers, wires placed on the ink containers, and the contact portions of the electrical contact circuit board of the ink jet recording head. As shown in FIG. 13, increasing in size the contact circuit board 204 of the ink jet recording head results in cost increase. Therefore, the contact circuit board 204 is desired to be minimized in size within the range in which it is large enough for a contact pad 209 to be placed electrically in contact with the main assembly. Thus, it sometimes occurs that as the ink containers 207*c*, 207*m*, 207*y*, and 207*k* are mounted into the ink jet recording head, the ink containers 207*c* and 207*m*, which are mounted in the center portion of the ink jet recording head, are allowed to come into contact with a contact circuit board 204, whereas the ink container 207*k* and 207*y* are not allowed to come into contact with the contact circuit board 204, for structural reasons.

Figure 15:
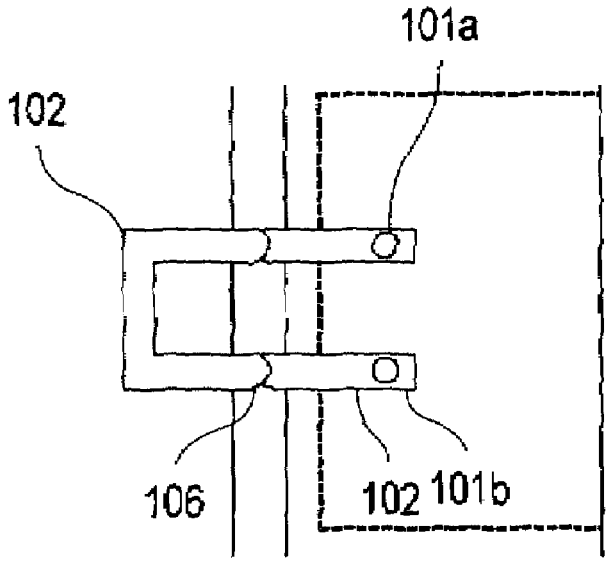
FIG. 15 is a schematic drawing of the junction between the electrical wires placed on the adjacent two ink containers in accordance with the present invention.

Therefore, in this seventh embodiment, in order to make it possible to detect the presence or absence of all ink containers 207 even if there is such a spatial limitation as the above described one, the driving voltage transmission line 102 is partially placed on the ink containers 207*k* and 207*c*, and the ends of the driving voltage transmission line 102 are provided with inter-ink container electrical contact points 106 so that the portions of the driving voltage transmission lines 102 placed on the ink containers 207*k* and 207*c* will be electrically connected. Thus, the driving voltage is transmitted through the portions of the driving voltage transmission lines 102 placed on the ink containers 207*k* and 207*c*. Although, in the above described seventh embodiment, the structural arrangement is such that the driving voltage is transmitted through the portions of the transmission lines 102, the number of the transmission lines 102 may be increased so that the electrical signals from the recording apparatus are also transmitted through the transmission lines 102. Further, the transmission lines 102 may be extended beyond the edge of the surface of the ink container to which the transmission lines 102 are attached, in parallel to the surface, so that the inter-ink container electrical contact points 106 are attached to the ends of the extended portions, as shown in FIG. 15. However, such a structural arrangement makes it possible for the transmission lines 102 to be bent when the ink containers 207 are inserted. Therefore, the structural arrangement such as the one shown in FIG. 13 is preferable, in which the contact points of the ink container 207*k*, and the contact points of the ink container 207*c*, are placed on the surfaces of the ink container 207*k* and 207*c* which will oppose each other as the ink containers 207*k* and 207*c* are mounted into the recording head. Moreover, it is desired that the electrical contact points 106 of both the ink containers 207*k* and 207*c* are made elastic to improve the electrical contacts 106 in reliability.

Figure 14:
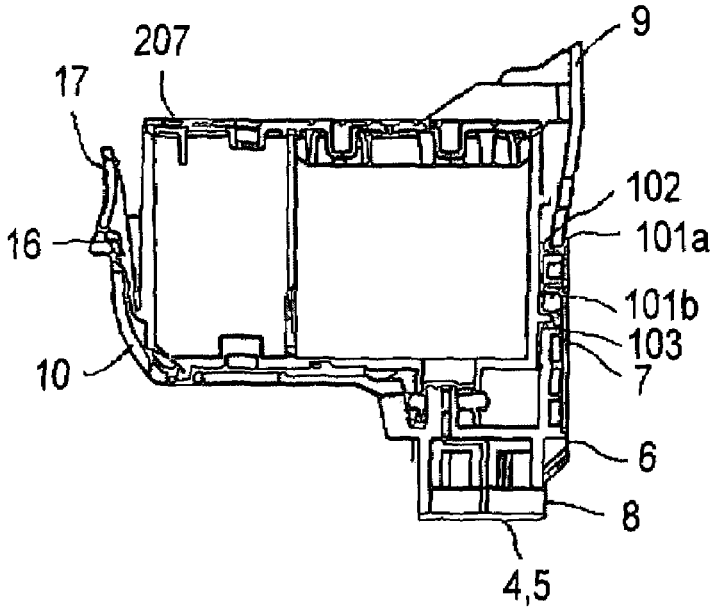
FIG. 14 is a schematic sectional view of the ink jet recording head, and ink container, in the seventh embodiment of the present invention.

Next, referring to FIG. 14, the contact circuit board 204 and contact portion of the ink container 207 are structured so that contact pins 101*a* and 101*b* through which the driving voltage and electrical signals are sent to the ink jet recording chip are placed on the back side of the contact circuit board 204 solidly fixed to the supporting member 205. The transmission line on the contact circuit board 204 are discontinuous between the contact points 101*a* and 10*b*; the driving voltage transmission line, or electrical signal transmission line, is discontinuous. Although, in this embodiment, the contact pins are placed on the contact circuit board 204, this is not mandatory; they may be placed on the electrical wire tape 203. The ink container 207 is firmly held against the supporting member 205, and the receptacle in the ink container holder 208, by the locking claw 103 and the projection of the latching lever 104. Further, the ink container 207 is kept pressured toward the contact circuit board 204 by the resiliency of the latching lever 104. As described above, designated by a referential number 102 is a piece of electrical wire. As the contact pins 101*a* and 101*b* are placed in contact with the transmission line 102, it becomes possible for the data to be sent to the ink jet recording chips 201 and 202 from the ink jet recording apparatus through the contact circuit board, multiple piece of electrical wire placed on the multiple ink containers, etc., to drive the electrothermal transducing elements. In this embodiment, the electrical wire 102 for the ink container 207 is a piece of flexible wire having the contact points to be placed in contact with the contact circuit board 204, and is pasted on the ink container 207.

With all the ink containers 207 structured as described above, if an attempt is made to drive the ink jet recording head when all the ink containers 207 are not in the ink container holder, the driving voltage from the main assembly of the ink jet recording apparatus is not sent to the ink jet recording chip. Therefore, the ink jet recording apparatus is not driven when no ink is in the ink jet recording chip, eliminating the concern that the ink ingredients will be baked onto the electrothermal transducing elements by an excessive amount. Therefore, it is possible to provide a highly reliable ink let recording apparatus without increasing the costs of the contact circuit board or electrical wire tape.

Figure 16:
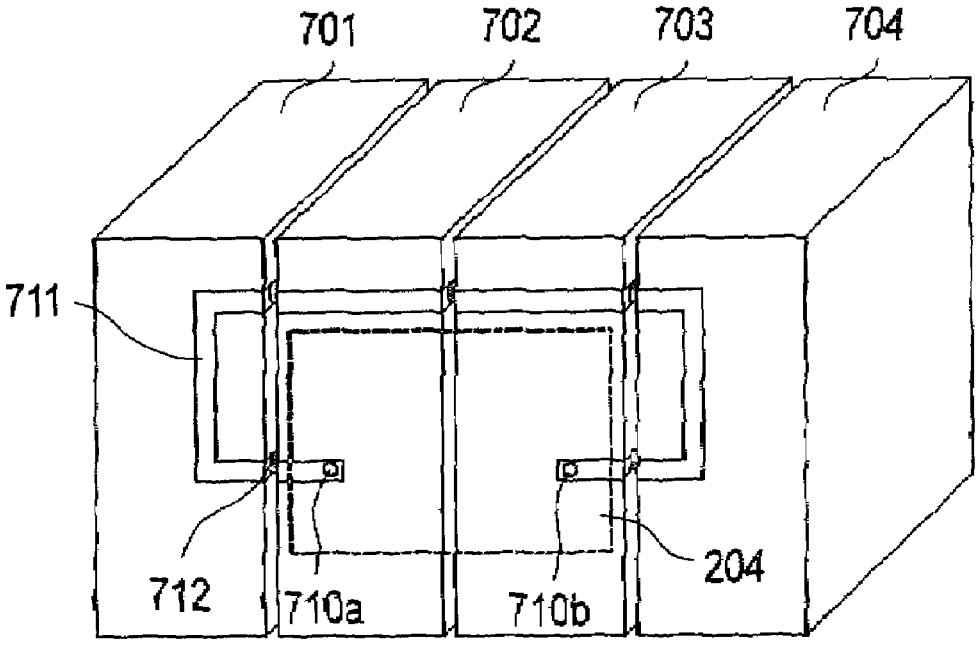
FIG. 16 is a perspective view of the electrical wires placed on the ink containers, electrical wires placed on the ink jet recording head, and junctions among them, in the eighth embodiment of the present invention.
Figure 17:
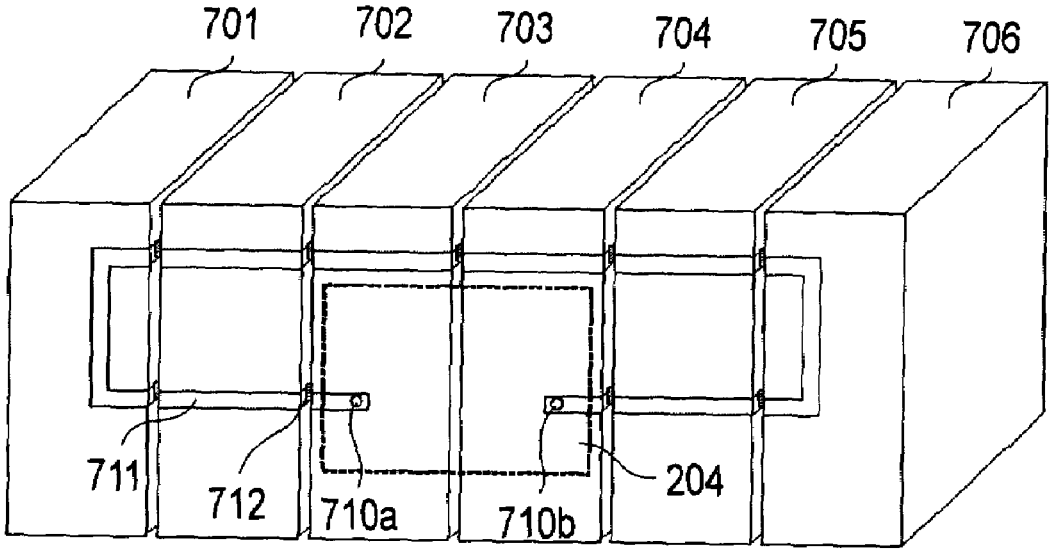
FIG. 17 is a perspective view of the electrical wires placed on the ink containers, electrical wires placed on the ink jet recording head, and junctions among them, in the modified version of the eighth embodiment of the present invention.

FIG. 16 is a schematic drawing showing the relationship among the ink containers, electrical wires placed on the ink containers, and contact portions of the contact circuit board of the ink jet recording head, in the eighth embodiment of the present invention. This embodiment is similar to the seventh embodiment, except that this embodiment is smaller in the number of the contact points of the ink jet recording head and ink container than the seventh embodiment. Thus, it is effective when a large area is not available, on the surface of the contact circuit board facing an ink container, for the contact pins, by which the contact circuit board is placed in contact with its counterparts on the ink container. Referring to FIG. 16, the ink container unit 701 has four ink containers 701, 702, 703, and 704, which contain yellow, magenta, cyan, and black inks, respectively. Each ink container is provided with an electrical wire 711, which is on the front surface of the ink container. The electrical wire 711 is provided with a pair of inter-ink container contact points 712, which are located at the ends of the electrical wire 711, so that only when all the ink containers are in the ink container holder, the transmission line, inclusive of the electrical wires 711, becomes continuous. In this embodiment, the electrical wires 711 are used as the parts of the transmission line through which the driving voltage is supplied from the ink jet recording head to the ink jet recording chip. On the ink jet recording head side, the electrical power voltage transmission wire is made discontinuous between the contact points 710*a* and 710*b*. The contact pin 710*a* is positioned so that it comes into contact with the electrical wire 711 placed on the ink container 702, which is to be placed in the center portion of the ink container holder, and the electrical wire of the ink container 702 connected to the contact point 710*a* becomes connected to one end of the electrical wire on the ink container 701, and the other end of the electrical wire on the ink container 701 become connected to one end of the other electrical wire of the ink container 702, and so on. As a result, the electrical wires on all the ink containers 701, 702, 703, and 704 become connected, and one end of the electrical wire on the ink container 703, or the other ink container placed in the center of the ink container holder, is placed in contact with the contact pin 710*b*. With the employment of the above described structural arrangement, only after the ink jet recording head is fitted with all the ink containers, it becomes possible for the driving voltage from the main assembly of the ink jet recording apparatus to be supplied to the ink jet recording chips through the ink jet recording head. In other words, even though the ink containers and contact circuit board in this embodiment are smaller in the number of the contact points than the ink containers and contact circuit board in the seventh embodiment, the ink jet recording heads are not driven when there is no ink in them, as the ink jet recording heads in the second embodiments are not, eliminating the concern that the ink ingredients are baked onto the electrothermal transducing elements by an excessive amount. Therefore it is possible to provide a highly reliable ink jet recording apparatus.

In this embodiment, the ink jet recording head is fitted with four ink containers different in the color of the ink they contain. However, the present invention is also applicable to an ink jet recording head to be fitted with six ink containers different in the color of the inks they container, that is, the four ink containers plus two more ink containers, for example, an ink container containing ink of light cyan color, an ink container containing ink of light magenta color, etc.

Figure 18:
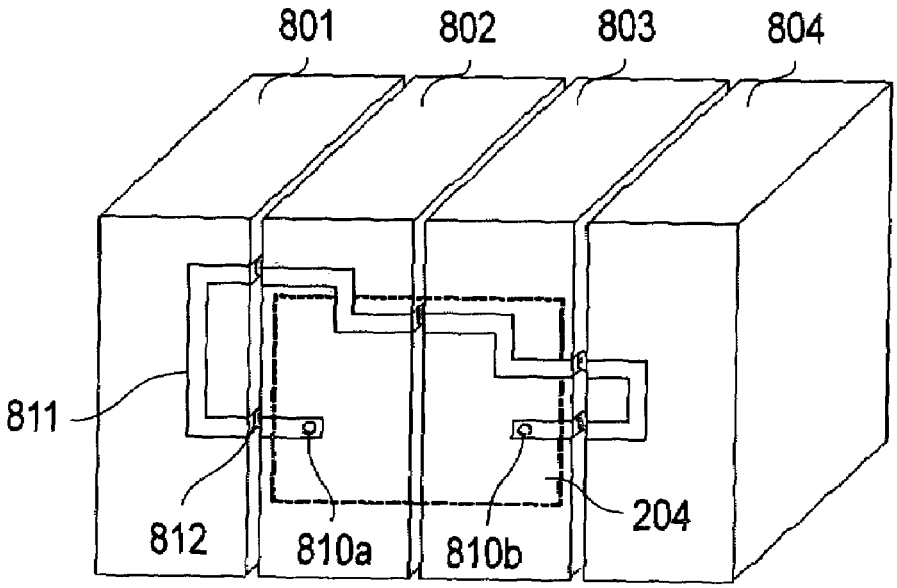
FIG. 18 is a perspective view of the ink containers, electrical wires placed on the ink containers, electrical wires placed on the ink jet recording head, and junctions among them, in the ninth embodiment of the present invention.

FIG. 18 is a schematic drawing showing another embodiment of the present invention, in which the four ink containers are varied in the configuration and position of the electrical wire 811, and the configuration of the inter-ink container electrical contact points 812. With the employment of the structural arrangement shown in FIG. 18, it is possible to provide a combination of an ink jet recording apparatus, an ink jet recording head, and an ink container, which is even more reliable in that it is not adversely affected by the insertion of an incorrect ink container.

Figure 19:
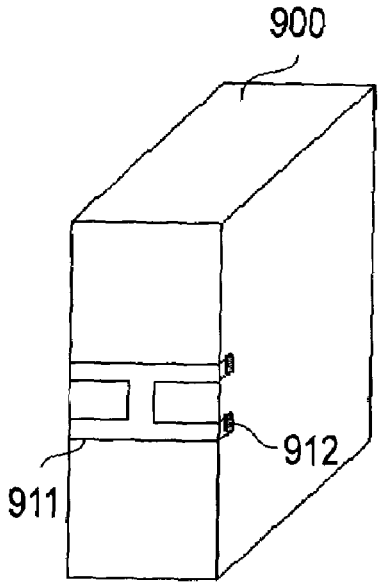
FIG. 19 is a perspective view of the electrical wires placed on the ink containers, electrical wires placed on the ink jet recording head, and junctions among them, in the tenth embodiment of the present invention.
Figure 19:
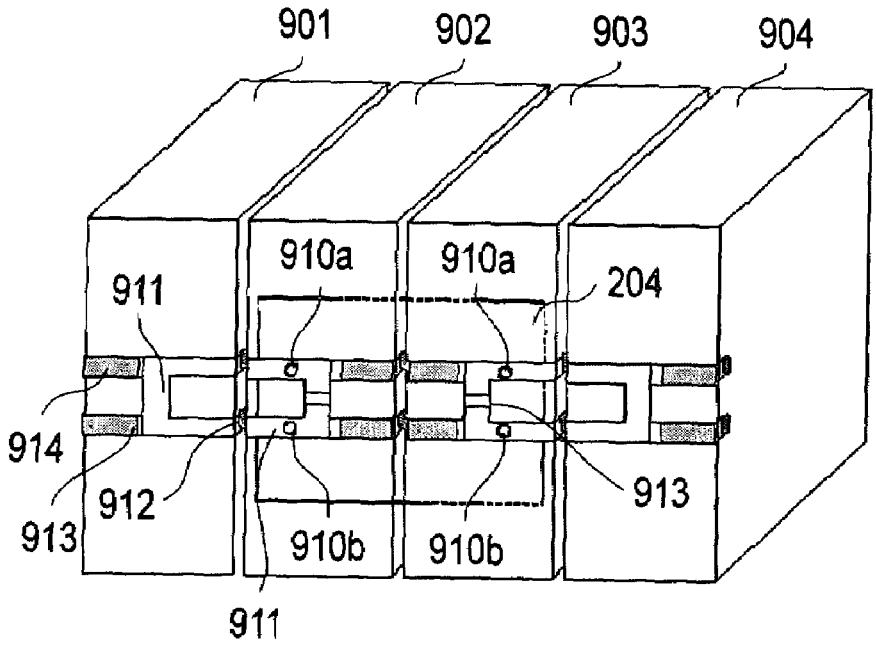
Figure 20:
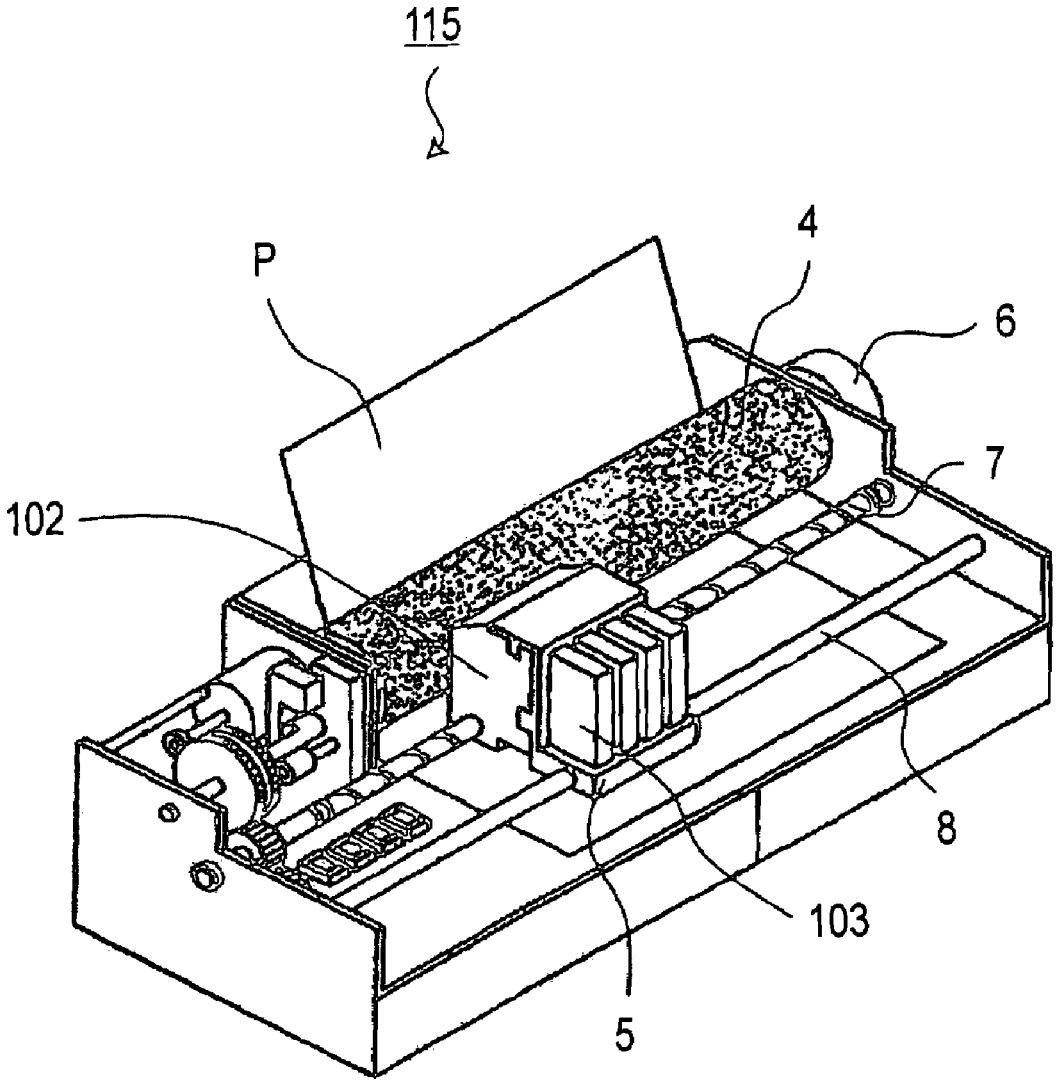
FIG. 20 is a perspective view of a typical ink jet recording apparatus in accordance with the prior art.

FIG. 19 is a schematic drawing showing the relationship among the ink containers, electrical wires placed on the ink containers, contact points of the contact circuit board of the ink jet recording head, in the tenth embodiment of the present invention.

In this embodiment, ink containers 900, which are identical in size, configuration, and the pattern of electrical wire 911, are employed as the base ink containers from which four types of ink containers 901, 902, 903, and 904, the wiring patterns of which are differentiated based on the color of the inks which they are to contain, are manufactured. More specifically, the portions 914 of the electrical wire 911 of each ink container are burned away with the use of a laser, or mechanically removed with the use of a cutter, a drill, or the like, as shown in FIG. 19(*b*), in order to give the electrical wire 911 a predetermined pattern which corresponds to the color of the ink it is to contain, that is, the position in the ink container holder, into which it is to be mounted.

With the employment of the above described manufacturing method, a single mold can be used for manufacturing various types of ink containers, that is, ink containers different in wiring pattern, making it possible to provided a combination of an ink jet recording apparatus, an ink jet head, and an ink container, which is much easier to manufacture, and much lower in cost, than that in the first embodiment.

As described above, in the case of the recording head cartridge in accordance with the present invention, unless it is correctly fitted with a proper number of correct ink containers, the driving voltage and electrical signals from the main assembly of a recording apparatus are not sent to the ink jet recording chips. Therefore, when no ink is in the recording chips, the electrothermal transducing elements in the ink jet recording chips are not driven. Therefore, the problem that ink ingredients are baked onto the electrothermal transducing elements, or the like problem, does not occur.

The ink containers are varied in the position of the electrically open portions of the electrical wire placed on each ink container, the configuration of the connective element, and/or the numbers thereof. Therefore, if an ink container incorrect in the color of the ink therein is mounted, the ink jet recording chip is not driven, preventing thereby the electrothermal transducing elements from being adversely affected.

Further, whether or not the driving voltage and/or electrical signals can be supplied to the recording head can be detected by the main assembly of a recording apparatus, making it thereby possible to detected the presence or absence of a given ink container. Therefore, it is possible to provide a combination of an ink jet recording apparatus, an ink jet recording head, and an ink container, which is economical and highly reliable.

Further, with the employment of one or a combination of the above described structural arrangements, unless a proper number of ink containers, which are correct in the color of the inks they container, are mounted into correct positions, one for one, the electrical signal and/or driving voltage from the main assembly of an ink jet recording apparatus are not sent to the recording chips. Therefore, the electrothermal transducing elements in the recording chips are not driven when no ink is in the recording head chips. Therefore, the problem that ink ingredients are baked onto the electrothermal transducing elements, or the like problem, does not occur.

With the ink containers varied in the pattern, configuration, and position of the electrical wire placed on each ink container, based on the color of the inks contained therein, if an ink container incorrect in the color of the ink therein is mounted, the ink jet recording chips are not driven, preventing thereby the electrothermal transducing elements from being adversely affected. Therefore, it is possible to provide a combination of an ink jet recording apparatus, an ink jet recording head, and an ink container, which is much higher in reliability. Further, it is possible to detect the presence or absence of a given ink container by detecting, on the main assembly side, that electrical power is not being supplied to the ink jet recording heads. Therefore, it is possible to provided a combination of an ink jet recording apparatus, an ink jet recording head, and an ink container, which is inexpensive and highly reliable.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application Nos. 397296/2003 and 308524/2004 filed Nov. 27, 2003 and Oct. 22, 2004, which is hereby incorporated by reference.

What is claimed is:

1. A recording head cartridge comprising:

a recording head having an ink jet recording chip for being driven by a driving voltage supplied through a driving voltage wiring lead and an electric signal supplied through an electric signal wiring lead to eject the ink; an ink container containing ink and detachably mountable to the recording head;

wherein at least one of said driving voltage wiring lead and said electric signal wiring leads include an electrical opening portion, and said ink container includes a connection element at a position facing the electrical opening portion having the at least one wiring lead, and wherein when said ink container is mounted to said recording head cartridge, the electrical opening portion is closed by the connection element to establish an electrical connection with the at least one wiring lead.

2. A recording head cartridge claim 1, wherein said cartridge comprises a plurality of such said ink containers for different colors, and wherein either one of both of said driving voltage wiring lead and said electric signal wiring lead have said electrical opening portion depending on colors of the ink contained in said containers.

3. A recording head cartridge claim 1, wherein said cartridge comprises a plurality of such said ink containers for different colors, and at least one of positions and configurations of said electrical opening portions of said ink containers are peculiar to colors of the ink contained therein.

4. An ink container according to claim 3, wherein a connecting wiring lead provided in said ink container has a common configuration in an unprocessed stage, and the peculiarity is given by a machining or laser machining.

5. A recording head according to claim 1, wherein said electrical opening portion is constituted by electrically insulated two contacts and a switch connected to one of said contacts, wherein said ink container has a projection at a position facing said switch, and wherein when said ink container is mounted to said recording head cartridge, said switch is depressed by said projection to contact to another said contact so that electrical opening portion is electrically closed.

6. A recording head cartridge claim 1, wherein said electrical opening portion is constituted by electrically insulated two contacts, and said ink container has a connection wiring lead at a position facing both of said contacts, and wherein when said ink container is mounted to said recording head cartridge, said connection wiring lead contacts both of said contacts to close said electrical opening portion.

7. A recording device comprising said recording head cartridge defined in any one of claims 1-6, further comprising detecting means which operate by detecting presence or absence of electrical conduction at the electrical opening portion of said recording head cartridge, thereby to detect presence or absence of a mounted ink container which is to close said electrical opening portion.

8. A device according to claim 7, wherein when said detecting means does not discriminate that said electrical opening portion is closed, a refreshing operation of said recording head is not carried out.

* * * * *

UNITED STATES PATENT AND TRADEMARK OFFICE

CERTIFICATE OF CORRECTION

PATENT NO. : 7,293,865 B2
APPLICATION NO. : 10/995359
DATED : November 13, 2007
INVENTOR(S) : Keiichiro Tsukuda et al.

It is certified that error appears in the above-identified patent and that said Letters Patent is hereby corrected as shown below:

COLUMN 1

Line 18, “facsimileing” should read --facsimile--.

COLUMN 2

Line 42, “amoun” should read --amount--.

COLUMN 3

Line 47, “provded” should read --provided--.

COLUMN 12

Line 40, “contacts 34a” should read --contacts 43a--, and “contact” should read --contact points--.

COLUMN 14

Line 17, “can” should be deleted.

COLUMN 16

Line 63, “let” should read --jet--.

COLUMN 17

Line 57, “container,” should read --contain,--.

COLUMN 18

Line 48, “whether or not” should be deleted;
Line 49, the first occurrence of “can be” should be deleted; and
Line 59, “container,” should read --contain,--.

UNITED STATES PATENT AND TRADEMARK OFFICE

CERTIFICATE OF CORRECTION

PATENT NO. : 7,293,865 B2
APPLICATION NO. : 10/995359
DATED : November 13, 2007
INVENTOR(S) : Keiichiro Tsukuda et al.

It is certified that error appears in the above-identified patent and that said Letters Patent is hereby corrected as shown below:

COLUMN 19

Line 13, "provided" should read --provide--; and
Line 43, "cartridge" should read --cartridge according to--.

Signed and Sealed this

Twentieth Day of January, 2009

JON W. DUDAS
*Director of the United States Patent and Trademark Office*